US011465806B2

(12) United States Patent
Sitwell et al.

(10) Patent No.: US 11,465,806 B2
(45) Date of Patent: Oct. 11, 2022

(54) LIQUID CONTAINER WITH A DISPENSER

(71) Applicant: DEXOS DRINKS LIMITED, London (GB)

(72) Inventors: Vincent Sitwell, London (GB); Kamila Sitwell, London (GB); Lucas Karel Johannes Van Den Broek, Sussex (GB)

(73) Assignee: DEXOS DRINKS LIMITED, London (GB)

( * ) Notice: Subject to any disclaimer, the term of this patent is extended or adjusted under 35 U.S.C. 154(b) by 612 days.

(21) Appl. No.: 16/477,880

(22) PCT Filed: Feb. 12, 2018

(86) PCT No.: PCT/IB2018/050845
§ 371 (c)(1),
(2) Date: Jul. 13, 2019

(87) PCT Pub. No.: WO2018/146645
PCT Pub. Date: Aug. 16, 2018

(65) Prior Publication Data

US 2019/0367217 A1 Dec. 5, 2019

(30) Foreign Application Priority Data

Feb. 10, 2017 (GB) ..... 1702249
Jul. 25, 2017 (GB) ..... 1711995
Nov. 9, 2017 (GB) ..... 1718540

(51) Int. Cl.
*B65D 21/02* (2006.01)
*B65D 43/02* (2006.01)
(Continued)

(52) U.S. Cl.
CPC ..... *B65D 21/0238* (2013.01); *B65D 43/0283* (2013.01); *B65D 81/3205* (2013.01);
(Continued)

(58) Field of Classification Search
CPC ..... B65D 21/0238; B65D 43/0283; B65D 81/3205; B65D 83/0033; B65D 83/0094;
(Continued)

(56) References Cited

U.S. PATENT DOCUMENTS 2,824,010 A * 2/1958 Pedersen ..... B65D 51/2821 426/115
3,347,410 A * 10/1967 Schwartzman .... B65D 81/3222 222/129

(Continued)

FOREIGN PATENT DOCUMENTS

CN 2 622 112 6/2000
CN 2 622 112 6/2004

(Continued)

OTHER PUBLICATIONS

PCT International Search Report, PCT/IB2018/050845, dated May 4, 2018.

(Continued)

*Primary Examiner* — Paul R Durand
*Assistant Examiner* — Michael J. Melaragno
(74) *Attorney, Agent, or Firm* — William H. Bollman

(57) ABSTRACT

A beverage container arranged to dispense a measured amount of a beverage is disclosed. The beverage container is adapted to be stored on the neck of the vessel and detached from the vessel to dispense the beverage either into the vessel or another vessel.

19 Claims, 18 Drawing Sheets

(51) Int. Cl.
*B65D 81/32* (2006.01)
*B65D 83/00* (2006.01)

(52) U.S. Cl.
CPC ..... *B65D 83/0033* (2013.01); *B65D 83/0094* (2013.01); *B65D 2401/15* (2020.05)

(58) Field of Classification Search
CPC ..... B65D 2401/15; B65D 51/28; B65D 51/2807; B65D 51/2814; B65D 81/2053; B65D 51/2821; B65D 51/2857
USPC ..... 222/391, 137, 139
See application file for complete search history.

(56) References Cited

U.S. PATENT DOCUMENTS 3,404,811 A * 10/1968 Cernei ..... G03D 3/06 206/508
5,071,034 A * 12/1991 Corbiere ..... A61J 1/2089 222/215
5,277,303 A 1/1994 Goyet et al.
5,647,481 A * 7/1997 Hundertmark ..... B65D 81/3211 206/568
5,687,866 A * 11/1997 Luch ..... B65D 41/0421 215/354
5,772,017 A * 6/1998 Kang ..... B65D 51/2842 426/115
5,908,107 A * 6/1999 Baudin ..... B65D 81/3211 215/DIG. 8
D415,959 S * 11/1999 Antoine ..... D9/724
5,975,369 A * 11/1999 Yurkewicz ..... B65D 47/243 220/257.1
6,045,254 A * 4/2000 Inbar ..... B65D 51/2864 215/DIG. 8
6,068,396 A * 5/2000 Baudin ..... B65D 25/085 215/DIG. 8
6,089,389 A * 7/2000 Sharon ..... A61J 9/00 215/11.4
6,113,257 A * 9/2000 Sharon ..... A61J 9/00 215/11.4
6,135,275 A * 10/2000 Kelders ..... B65D 81/3211 215/DIG. 8
6,165,523 A * 12/2000 Story ..... B65D 51/2828 426/115
6,244,433 B1 * 6/2001 Vieu ..... B65D 81/3211 222/129
6,247,586 B1 * 6/2001 Herzog ..... B65D 81/3211 215/DIG. 8
6,293,395 B1 * 9/2001 Hof ..... B65D 81/3211 206/219
6,321,908 B1 * 11/2001 Lorscheidt ..... B65D 81/3211 215/DIG. 8
6,527,110 B2 * 3/2003 Moscovitz ..... B67B 7/26 215/DIG. 8
6,533,113 B2 * 3/2003 Moscovitz ..... B65D 81/3211 215/DIG. 8
6,959,807 B2 * 11/2005 Sharon ..... B65D 81/3211 206/568
6,994,211 B2 * 2/2006 Cho ..... B65D 51/2864 215/DIG. 8
7,066,323 B1 * 6/2006 Reisman ..... B65D 21/0231 366/130
7,156,227 B2 * 1/2007 De Laforcade .... B65D 81/3211 215/DIG. 8
7,308,915 B2 * 12/2007 Johns ..... B65D 81/3211 141/100
7,377,383 B2 * 5/2008 Henry ..... B65D 81/3211 220/4.27
7,607,460 B2 * 10/2009 Johns ..... B65D 81/3211 141/319
7,635,012 B2 * 12/2009 Johns ..... B65D 51/2814 141/112
8,226,126 B2 * 7/2012 Johns ..... F16L 29/005 285/3
8,800,816 B2 * 8/2014 Summons ..... B05C 17/00593 222/327
9,016,488 B1 * 4/2015 Peres ..... A61J 9/008 215/11.1
9,067,716 B2 * 6/2015 Cronin ..... B65D 51/2864
9,339,439 B2 * 5/2016 Nudo ..... B65D 81/3211
9,743,803 B2 * 8/2017 Foster ..... B65D 81/3211
9,821,938 B2 * 11/2017 Valentine ..... B65D 81/3255
10,065,775 B2 * 9/2018 Estes ..... B65D 41/3428
10,730,682 B2 * 8/2020 Rahmel ..... A61J 1/2089
10,737,868 B2 * 8/2020 Rahmel ..... A61J 1/2089
11,026,863 B2 * 6/2021 Rahmel ..... A61J 1/2027
11,235,920 B2 * 2/2022 Anderson ..... B65D 51/2821
2003/0034323 A1 * 2/2003 Smith ..... B65D 55/024 215/253
2004/0079765 A1 * 4/2004 Gallo, Jr. ..... B65D 50/046 222/548
2004/0154937 A1 * 8/2004 Cho ..... B65D 51/2864 206/219
2005/0173368 A1 * 8/2005 Nusbaum ..... B65D 55/024 215/253
2007/0023299 A1 * 2/2007 Clarkson ..... B65D 51/2835 206/219
2009/0230152 A1 9/2009 Laurent et al.
2012/0067922 A1 * 3/2012 Benoit-Gonin ..... B65D 55/024 222/546
2015/0203260 A1 * 7/2015 Kim ..... B65D 51/2814 426/112
2016/0023825 A1 * 1/2016 Van Den Broek ..... B65D 41/3419 215/227
2019/0367217 A1 * 12/2019 Sitwell ..... B65D 81/3205
2021/0122542 A1 * 4/2021 Jo (Zee) et al. ... B65D 83/0094
2021/0253319 A1 * 8/2021 Sitwell ..... B65D 51/2864

FOREIGN PATENT DOCUMENTS

| | | |
|---|---|---|
| EP | 2899137 | 9/2014 |
| FR | 2 258 314 | 8/1975 |
| FR | 2903092 | 7/2006 |
| FR | 2 903 092 | 1/2008 |
| WO | 2004/069673 | 8/2004 |
| WO | 2016/208859 | 4/2016 |

OTHER PUBLICATIONS

PCT Written Opinion of the International Searching Authority, PCT/IB2018/050845, dated Aug. 16, 2018.

* cited by examiner

LIQUID CONTAINER WITH A DISPENSER

FIELD OF THE INVENTION

This invention relates generally to devices in the form of a beverage vessel closure to dispense a measured amount of a beverage. More specifically the invention relates to devices adapted to dispense the beverage as a cordial for flavouring or nutritional supplement into the beverage vessel closure itself and into another vessel containing another beverage for drinking.

BACKGROUND

Sealed beverage vessels store and preserve beverages for drinking. A beverage is contained in the vessel for storage and poured out of the vessel for use.

Some beverage flavourings such as natural juices deteriorate quickly unless kept pure and sealed. Some beverage flavourings decompose when mixed with other beverages.

PRIOR ART

From the distant past, flavourings and beverages which decompose when mixed with another beverage have simply been stored in separate vessels. This has always had the disadvantage of requiring at least two vessels.

More recently dispenser caps have been introduced such as that in a disclosure by Dejonge in publication US-A1-20090139882. However, these caps are permanently fixed to the vessel so that the advantage of being able to mix beverages and flavourings from any two vessels is lost.

A disclosure by Kim et. al. in publication EP-A1-2899137 reveals a stopper for a food-beverage vessel. The stopper also closes the vessel. A cover is removed from the stopper to access a container inside the stopper which contains the functional beverage. A seal must be broken to pour the functional additive out of the stopper.

A disclosure by Bowes et. al. in publication U.S. Pat. No. 3,156,369 reveals a bicameral container for storing, mixing, and dispensing two different materials which are kept separate until just prior to the time when they are mixed for use. The container is accessed by breaking a seal on a cover. The containers are permanently fixed to a bottle.

A disclosure by Moscovitz in publication US-A1-2002/006677 reveals a container for storing and dispensing a food or drug composition. It comprises a seal that can be broken after being securely connected to a bottle.

A disclosure by Coon in publication US-A1-2011/0174642 reveals a container having a frangible membrane which is torn to release the full contents of the container. The container is unscrewed from bottle to open the bottle.

A common theme of the above disclosures of prior art is a container arranged to dispense a product directly into a bottle.

A disclosure by Seo et. al. in a publication WO-A1-201608859 reveals a dropper with an elongate spout which dips into a liquid contained a bottle. The spout comprises a bulb at first end to draw liquid into a distal end the spout. When the dropper is removed from the bottle, the bottle is opened. A theme of this disclosure is a device to dispense a liquid which is in the bottle.

A new invention is required that is a departure from this established thinking.

SUMMARY OF THE INVENTION

According to a first aspect of the invention, a beverage container comprises: an over-cap detachable from a body, the over-cap detachably connects the body to a drinks vessel and covers an entrance to the vessel; a portion of the body is adapted to be squeezed or displaced to dispense a beverage from a reservoir in the body through a passage through the body; characterised in that the over-cap and a portion of the body which receives and attaches to the over-cap, cooperate to hold the over-cap on the vessel as the body is being detached from the vessel.

Preferably the vessel is a bottle, flask, jar, or other portable vessel with an opening closable by a cap that is used to store, transport, and pour a beverage. Such a vessel is referred to herein as a drinks vessel because it is used to store and pour a vessel for drinking.

Preferably the over-cap detachably connects the vessel to a vessel cap. The vessel cap connects to the vessel and closes the entrance into the vessel. The beverage container is connected to the vessel by being connected to the vessel cap which is connected to the vessel.

Preferably the vessel cap consists of pasteurisable material which withstands pasteurisation temperatures while maintaining shape to remain in position on the vessel. Preferably the vessel cap withstands pasteurization temperatures above 55 degrees C. for at least 30 minutes, or preferably temperatures above 65 degrees C. for at least 30 minutes, or preferably temperatures above 75 degrees C. for at least 1 minute, or preferably temperatures above 150 degrees C. for at least 10 seconds to pasteurise beer, milk, or juice. Preferably the vessel cap is a screw-on cap for twisting on and off a bottle neck to open and close the vessel and preferably the vessel cap comprises aluminium because it is pasteurisable.

Preferably the over-cap is arranged to be connected around the entrance into the vessel and to cover the entrance. Preferably the over-cap is arranged to be connected to a neck of the vessel around the entrance. Preferably the over-cap is arranged to cover the neck. Preferably the over-cap closes the entrance.

Preferably the over-cap is arranged for the neck being a bottle neck.

Preferably the over-cap is detachable from the body. The beverage container is thereby separable into at least two parts.

Preferably one of the parts is a body and the over-cap is detachable from the body. Preferably the body comprises the remainder of the beverage container when the over-cap is detached from the body.

Preferably the body comprises the portion which when squeezed or displaced dispenses the beverage.

Preferably the body includes an article which encloses or partially encloses the reservoir. Preferably the body comprises an assembly of the article and the portion adapted to be squeezed or displaced to dispense a beverage from the reservoir.

Preferably the over-cap is detachable from the article.

Preferably the beverage container comprises a portion to receive and attach to the over-cap. Preferably the body includes the portion to receive and attach to the over-cap. Preferably the portion to receive and attach to the over-cap is a socket.

Advantageously the over-cap is removable from the socket.

Preferably the beverage container has formed therein the socket in which the over-cap is attachable to the container. Preferably the socket is formed in the article.

Preferably the body, and more preferably the article, is mounted on the vessel over the entrance by the over-cap received in the socket. Advantageously the beverage container is thereby mounted on the vessel.

Preferably the passage is from the reservoir into the socket. The beverage in the reservoir may be dispensed through the nozzle preferably into the socket or out through an opening in the socket to receive the over-cap.

Preferably the passage is a nozzle, preferably the nozzle comprises a tube with a taper or constriction used to speed up or direct a flow of the beverage. The beverage is thereby easily ejected out through the socket.

Preferably the beverage container comprises a partition dividing a hollow interior to form the socket and the reservoir. Preferably the hollow interior is in the body and preferably in the article.

Preferably in the article there is a hollow interior and the partition dividing the interior to form the socket and the reservoir enclosure.

Preferably the beverage container has first and second openings which are preferably in the body or article. Preferably the two openings are opposite ends of the beverage container or article. The two openings are openings into the hollow interior which preferably provide the hollow interior with open ends. Preferably the open ends are opposite the partition.

Preferably the passage is through the partition. Preferably the nozzle protrudes from the partition towards the first opening for receiving the over-cap. Preferably the opening is defined by the socket.

Preferably the over-cap and the portion of the body which receives and attaches to the over-cap cooperate to hold the over-cap on the vessel as the body is being detached from the vessel.

Preferably the socket is the portion of the body which receives and attaches to the over-cap and cooperates with the over-cap to hold the over-cap on the vessel.

Preferably the over-cap and the socket cooperate to hold the over-cap on the vessel where the over-cap is a preselected distance into the socket. Preferably the distance is a preselected distance from a stop in the socket. Preferably the stop is the partition or the nozzle.

Preferably the over-cap and socket so cooperate from a position where the over-cap contacts the partition or stop to the preselected distance.

While the over-cap is being removed from the socket from the position of contact to the preselected distance from the partition the over-cap is held on the vessel. Advantageously over this range of distance the body may be unscrewed off the over-cap while the over-cap is prevented from being similarly unscrewed from the vessel.

Preferably the over-cap comprises a first lock which interlocks with a second lock on the vessel. The over-cap is held on the vessel by the interlock.

Preferably the body comprises a holding means to prevent the first lock from being freed of the interlock with second lock as the body is being detached from the vessel.

Preferably the article comprises the holding means. Preferably the socket comprises the holding means.

Preferably the holding means engages the first lock to interlock the first lock with the second lock.

Preferably the holding means comprises a portion of the socket arranged to slip fit around the over-cap.

Preferably the socket covers the over-cap which covers the neck and entrance of the vessel where preferably the holding means engages the first lock with the second lock. In this configuration the article comprising the reservoir is conveniently attached to and stored on the vessel.

Preferably the over-cap and the portion the body which receives and attaches to the over-cap disengage where the body is being detached from the vessel to free the over-cap for detachment from the vessel.

Preferably where the holding means disengages from the first lock, the first lock is freed to unlock from the second lock to detach the over-cap from the vessel. Where the first lock is free from the holding means, the over-cap is freed from the second lock.

Preferably the first lock is unlocked from the second lock by disengagement of the first lock from the holding means. The over-cap is thereby unlocked from the vessel and freed for detachment from the vessel.

Preferably the holding means disengages from the first lock from where the over-cap enters the socket to the preselected distance from the partition or the stop in the socket.

Preferably a portion of the over-cap for covering the entrance comprises a shutter for shutting the passage which is preferably a nozzle.

Preferably the shutter is arranged with respect to the holding means to shut the passage or nozzle where in the socket the holding means engages the first lock with the second lock. Preferably the shutter shuts the passage or nozzle when the over-cap is received in the socket.

Preferably the shutter is arranged with respect to the holding means to unshut the passage where the holding means is disengaged from the first lock to unlock the first lock from the second lock. Preferably the shutter is arranged to unshut the passage where the over-cap is at position in the socket where the holding means is disengaged from the first lock.

Preferably the shutter is arranged to unshut and preferably unblock the passage or nozzle when the over-cap is removed from the socket.

Preferably the shutter comprises a portion of the over-cap which seals around the nozzle to shut it. Preferably the shutter is formed by a portion of the over-cap which inserts into the passage or nozzle to shut it.

Preferably the portion of the body that is adapted to be squeezed or displaced to dispense the beverage from a reservoir is a piston slide-able in the reservoir.

Preferably the beverage container is for storage of a first beverage in the reservoir on a vessel for a second beverage.

Advantageously the first beverage is storable in the reservoir while the second beverage is storable in the vessel. The first beverage may be dispensed and used separately from the second beverage.

Advantageously the body is removable from the over-cap while the over-cap covers a vessel cap and while the over-cap is attached to the vessel.

Preferably the over-cap is functional as a bottle cap or vessel cap so that a separate bottle cap or vessel is not necessary to close the vessel entrance.

Advantageously the beverage container is portable. The article may be held with the open end of the socket up when the first beverage is ejected into the socket so that the socket is a temporary cup for holding the ejected first beverage. The article may be held with the open end of the socket down so that when the first beverage is ejected into the socket, it pours down through the open end.

Preferably the socket has a rim of the opening to receive the over-cap. Preferably the rim is arranged for a user to drink or sip a beverage in the socket.

Advantageously, after the article is removed from the over-cap by taking the over-cap out of the socket, the second beverage in the vessel may be used separately from the first beverage. The second beverage may be poured from the vessel into a jug or mixing cup or into the socket. The first beverage may be ejected into the jug or mixing cup to mix with the second beverage.

The first beverage may be ejected from the reservoir through the nozzle into the portion of the beverage container which receives the over-cap which is preferably the socket and then poured out or drunk directly from the socket.

The first beverage may be ejected through the nozzle and directly into the second beverage either by ejecting the first beverage through the entrance of the vessel wherein the second beverage is contained.

Preferably the first beverage is an edible product in the form of liquid, gel, slurry, or frozen product which can be ejected when thawed. Preferably the first beverage comprises ingredients including water, sugar, alcohol, vegetable or fruit juice, a dairy product such as milk, or a mixture of these. It is not essential that the first beverage includes any of these ingredients.

Preferably the article is a single unit. Alternatively, the article is comprised of a plurality of units wherein a first unit includes the socket and a second unit encloses the reservoir enclosure. Preferably the first unit comprises the partition or preferably the second unit comprises the partition.

Preferably the body or article is formed of a tube comprising the partition dividing the hollow interior.

Preferably the beverage container is arranged for storage of a beverage on a neck of vessel and comprises: an article in the form of a tube comprising a partition dividing the hollow interior to form a socket and a reservoir enclosure, and a nozzle through the partition; a piston in the interior sealing the reservoir for ejecting a beverage in the reservoir into the socket; and an over-cap for connecting the beverage container to the vessel comprising a shutter on a portion for covering the vessel entrance for shutting the nozzle when the over-cap is received in the socket.

Preferably the over-cap comprises a skirt joined to the circumference of the portion of the over-cap which covers the vessel opening. Preferably the skirt includes the first lock to interlock with the second lock on the vessel and prevent twisting of the over-cap when the over-cap is pressed or screwed onto the vessel neck. Advantageously the over-cap can only be twisted off the vessel neck when the first lock is free to unlock from the second lock device.

Preferably the first and second lock devices comprise a lug, protrusion, or clevis.

Preferably the skirt comprises a resilient material which permits the skirt to expand radially to unlock the first lock from the second lock when a preselected torque is applied.

The skirt is permitted to expand when the holding means disengages from the first lock.

Preferably the skirt extends from the portion of the over-cap which covers the vessel opening to a rim of the over-cap opening to receive the vessel.

Preferably the over-cap comprises a separate ring separated from a first rim of the skirt by a circumferential gap and joined to the first rim by fingers. Preferably the separate ring comprises the first lock lug. Advantageously the fingers and separate ring are flexible which permit the separate ring to expand easily when the torque is applied and so easily unlock the first lock from the second lock.

Preferably the skirt comprises a first screw thread to engage the portion of the beverage container which receives the over-cap which is preferably the socket.

Preferably the first lock is on the skirt intermediate the screw thread and the rim of the over-cap.

Preferably, the socket is arranged to cover the skirt when the over-cap is received therein to prevent the skirt from expanding to unlock the first lock from the second lock.

Preferably there is formed a slip fit between the socket and the skirt. Preferably the socket slips around the skirt when over-cap is received in the socket where the shutter shuts nozzle.

Preferably the holding means is a circumferential portion of the socket which forms the slip fit around the skirt where first lock is located.

Advantageously, the over-cap cannot be twisted off the vessel neck while the over-cap is received in the socket where the circumferential portion of the socket which forms the slip fit engages the first lock.

Advantageously the over-cap is easily removable from the vessel neck when the over-cap is removed from the socket by twisting off the over-cap with a preselected torque which causes the skirt to expand and unlock the first lock from the second lock.

The portion of the beverage container enclosing the reservoir and which receives the over-cap, preferably the portion being the body or article comprising the socket and the reservoir enclosure, can be twisted off and screwed from the over-cap without the over-cap twisting on the vessel neck. So advantageously the article can be removed from a storage position on the vessel while leaving the over-cap connected on the vessel and covering the vessel opening.

After the portion of the beverage container which receives over-cap, preferably the portion being the article is taken off the over-cap, the over-cap is exposed on the vessel. The over-cap is removable from the vessel by applying a preselected amount of torque to the over-cap. The torque disengages the first lock from the second lock and twists the over-cap off the vessel. The entrance to the vessel is thereby uncovered.

Hence advantageously the beverage container and the vessel are useable separately.

The first beverage can be ejected from the container separately, and the second beverage can be poured from the vessel separately.

Preferably the over-cap is functional as a bottle cap or vessel cap so that a separate bottle cap or vessel is not necessary to close the vessel entrance.

Preferably the reservoir is bounded by the piston and the tube or cylinder of the body or article in which the piston is displaceable. Preferably the reservoir is enclosed by the piston assembled with the article.

Preferably the tube has a cross section which is cylindrical. Preferably the tube has a cross section or other than cylindrical without interior corners so the piston cross section without corners conforms to the tube cross section.

Preferably the tube or cylinder portion of the body which bounds the reservoir is transparent or translucent. Advantageously the beverage in the reservoir may be observed. Preferably the transparent or translucent portion is marked with graduations to show volume of the beverage in the reservoir or which has been dispensed from the reservoir. Advantageously a measured amount the beverage may be dispensed.

Preferably the reservoir is partially enclosed by a compartment of the beverage container having the first open end. Preferably the compartment is the tube or cylinder in which the piston or portion is squeezed or displaced to dispense the beverage.

Preferably the piston is displaceable to proximate the first open end to form the reservoir maximum volume. Preferably the piston is displaceable to increase the reservoir volume until stopped by the bumper proximate the first open end of the body or article sealed off by the piston.

Preferably the piston and partition have matching contours which when brought into contact by displacement of the piston deprive the reservoir of volume.

Preferably the piston is displaceable to reduce the reservoir volume until stopped by the partition. Where the piston is proximate the first open end, the cylinder is at maximum volume. Where the piston is pushed until in contact with reservoir, the reservoir has nil volume.

Preferably the partition and piston have mating surfaces with matching contours.

Preferably the piston head has rigidity that is provided by a thickness of the material at the head of piston, or by a concave shape of the piston head with the concavity facing inwards into the reservoir, or by ribs on piston head which reinforce it. Advantageously the rigidity helps maintain the orientation of the piston in the reservoir and maintain the matching contour.

Preferably the piston head has a soft, deformable interior surface of the reservoir. Preferably the piston head is flexible. Advantageously by virtue of a soft deformable surface facing the interior of the reservoir or flexibility, the piston head conforms to the partition contour when pressed against the partition.

Advantageously when this piston is pressed against the partition, the mating surfaces are brought into contact ejecting substantially all the beverage from the reservoir by depriving the reservoir of volume. Since there is no volume left in the reservoir, all the beverage is ejected.

Preferably the reservoir is enclosed by the tube or cylinder, the piston, and the partition that separates the reservoir from the opening in the container for receiving the over-cap.

Preferably the piston is a one-piece unit.

Preferably the piston seals the reservoir, preferably by means of the piston comprising a sliding seal. Advantageously neither the beverage inside the reservoir or air may by-pass the piston.

Preferably when the shutter shuts the nozzle, the nozzle is sealed closed. Advantageously effervescent beverages are storable in the reservoir.

Preferably a sliding seal circumscribes the piston. Preferably the sliding seal seals the piston to a portion of the beverage container enclosing the reservoir. Preferably the sliding seal seals the piston to the body or article. The piston is sealed within the reservoir and the reservoir is sealed closed by the piston.

Preferably, the piston comprises a head circumscribed by a sliding seal. Advantageously the beverage in the reservoir and air is prevented from by-passing the piston. The beverage in the reservoir can only escape the reservoir by being ejected through the nozzle.

Preferably the shutter shuts the passage or nozzle when the over-cap is received in the socket so that the piston cannot be displaced when the reservoir is full of an incompressible material such as a beverage.

Preferably the sliding seal is formed of resilient polymer.

Preferably the sliding seal comprises a circumferential flap around the piston tubular portion or piston head. Preferably the sliding seal comprises a pair of circumferential flaps. The flaps are axially space apart on the piston to form a sealed volume between the flaps and the reservoir enclosure and the piston head or piston tubular portion.

Preferably the head of the piston and the sliding seal are integrally formed, and preferably of a single material.

Preferably the sliding seal comprises a flexible O-ring which makes circumferential contact with the reservoir enclosure.

Preferably the flexibility of the sliding seal is provided by a thickness of the material proximate the circumference the piston head is which is thin as a membrane which preferably forms a flexible flap.

Of the two openings which are preferably in the body or article, the first opening is preferably the socket opening to receive the over-cap. The second opening is preferably to receive the piston for assembly of the beverage container.

Preferably the second opening is arranged to provide finger access to the head of the piston. A user operates the piston with their finger to dispense the beverage. Advantageously a user can readily observe that depressing the piston or a button on the end of the outer casing of the article can be done with just one hand.

Preferably the head comprises or is formed of rigid material. The head can be pressed by a user's finger in through the open end of the portion of the beverage container enclosing the reservoir preferably the article and closed off by the piston to eject the beverage in the reservoir.

Preferably a portion of the body wherein the reservoir is enclosed by the piston assembled with the article, comprises rigid materials.

Advantageously, when the beverage freezes and expands in the reservoir, the piston can slide to increase the reservoir volume to accommodate the volume of the frozen beverage without damaging the article or popping the shutter open. Hermetic storage of the beverage in the reservoir is maintained.

Preferably, the sliding seal is a friction coupling which holds the piston in place in the reservoir enclosure against the weight of the piston itself when the nozzle is unblocked from the shutter. The weight of the piston cannot eject the beverage in the reservoir out through the nozzle. Only when the piston is pushed, such as by a user, is the beverage ejected through the nozzle.

Advantageously the body or article enclosing the reservoir may be carried portably and separately from the over-cap and the vessel by the user without the beverage dribbling out of the nozzle.

Preferably the reservoir enclosure comprises a bumper proximate the open end sealed off by the piston which prevents the piston exiting the reservoir enclosure. The maximum volume of the reservoir is limited by the piston against the bumper. Preferably the bumper is shaped to allow the piston to be received into the reservoir for assembly, but not exit the reservoir in use.

Preferably the friction coupling holds the weight against the piston itself and the weight of the first beverage which fills the maximum volume of the reservoir.

Preferably the volume of the socket is preselected for use as a drinking cup or measuring cup.

Preferably the volume in the socket when the over-cap is removed is substantially equal to the maximum volume of the reservoir. Preferably the volume of the socket is more than one hundred percent of the maximum volume of the reservoir. Preferably the volume of the socket is less than one hundred and ten percent of the volume of the reservoir.

Preferably the maximum volume of the reservoir is 10 ml, 15 ml, 20 ml, 25 mil, 30 ml, 35 ml, 40 ml or 50 ml or greater, but preferably less than 250 ml and more preferably less than 100 ml.

Preferably a portion of the first beverage, and preferably all of the first beverage, in the reservoir may be ejected into the socket. Advantageously the socket may be used as a drinking or measuring cup. Preferably the socket has measurement indication means to indicate the fraction of the first beverage ejected into the socket from the maximum volume of the reservoir.

Advantageously the first beverage does not flow back into the reservoir after being ejected into the socket because the friction coupling holds the weight against the piston itself and the weight of the first beverage which fills the maximum volume of the reservoir. This prevents the piston slipping and allowing the beverage back into the reservoir.

Preferably the friction coupling holds the weight against the piston itself and the weight of the first beverage which fills the maximum volume of the socket. Preferably the volume of the socket is sized to accept the volume first beverage equal to the maximum volume of the reservoir and a second volume of another beverage, for example the second beverage, mixed with the first beverage. Advantageously the socket may be used as a cup for drinking the mixed beverage without the piston slipping and allowing the mixed beverage into the reservoir.

For the purpose of determining the weight of a beverage according to volume, a specific gravity of between 0.9 and 1.1 is preferably used. Advantageously the volumes of the socket, reservoir and the weight the friction coupling supports may be sized for generic first and/or second beverages with typical specific gravity.

Preferably the sliding seal is a friction coupling which holds the piston in place against the weight of the piston itself and a weight of a beverage having a specific gravity of 1.1 and the volume of the socket when the over-cap is removed from the socket.

When the over-cap is removed from the socket there is volume in the socket from the partition to the socket opening. The socket may be filled with a beverage from the partition to the rim of the partition opening. This is the maximum volume of a beverage the socket can contain. Advantageously the socket may be filled by ejecting the first beverage in the reservoir into the socket or by pouring another beverage such as the second beverage in the vessel into the socket. The beverage container and preferably the article is thus a convenient holding cup from which to drink, pour, or mix beverages.

Preferably the piston or nozzle dimensions and material in which the piston are formed are arranged for a preselected beverage. Preferably the dimensions and materials are arranged to maintain a column of the beverage in the nozzle when the reservoir is full of the beverage. The surface tension of the preselected beverage, air pressure outside the beverage container, and affinity of the beverage to adhere to the nozzle material maintain the column of the beverage in the nozzle.

Advantageously, air cannot enter the reservoir through the nozzle even when the nozzle is not shut by the shutter because the column of the beverage in the nozzle blocks the air. Advantageously the beverage cannot leak or drip or dribble out of the nozzle when the piston is held in position by the friction coupling because air cannot get into the reservoir.

Preferably the collapsible portion is a resiliently deformable boundary or wall of the reservoir.

Preferably the portion that is collapsible or squeeze-able to dispense the beverage comprises a flexible portion of a tubular portion of the reservoir. Preferably the flexible portion is resilient and is arranged automatically return to its un-squeezed or un-collapsed position when released Preferably the portion that is collapsible or squeeze-able to dispense the beverage comprises a depress-able button instead of a piston to aid a user to change the volume of the reservoir. Whereas the piston slides in the reservoir, the button is preferably fixed to the body.

Preferably the button is resilient and is arranged automatically return to its un-squeezed or un-collapsed position when released.

Preferably the depress-able button forms a boundary of the reservoir at an end of the reservoir distal from the nozzle.

Preferably the depress-able button closes an end of the outer casing distal from the opening to receive the over-cap.

Preferably the button is sealed around the end of the tube. Preferably the button is sealed around the end of a tube or a tubular section of the beverage container defining a boundary of the reservoir and exterior surface of the beverage container.

Preferably the portion which when squeezed dispenses the beverage from the reservoir via a nozzle is resilient or is flexible and acted on by a resilient means. Preferably the portion which when squeezed dispenses the beverage includes the button.

Preferably the button comprises a resiliently deformable portion connected to a wall the tube to urge the button from a depressed position to an undepressed position.

After the resiliently deformable portion, preferably including the button, is squeezed, it returns to a not squeezed configuration. By repeated squeezing of the portion, and preferably the button, the beverage is pumped from the reservoir.

Preferably each time the button is depressed, a known metered amount of the beverage in the reservoir is ejected.

Preferably the resiliently deformable portion comprises a flap that is the resilient means, which extends from a wall of the tube into the reservoir to lift the button from the depressed position to the undepressed position.

Preferably the tube is comprised of a reservoir part comprising the collapsible portion and a receiver part comprising the socket and the partition.

Preferably the reservoir part joins to the receiver part by a liquid tight joint to enclose or partially enclose the reservoir.

Preferably the reservoir part and receiver part connect by a snap fit or a press fit or a screw thread.

Preferably the over-cap comprises a cap top to cover the bottle opening, wherein the over-cap top has a depression to temporarily receive the nozzle and seal the reservoir closed.

Preferably the over-cap is arranged to cap over the vessel cap. Preferably the vessel cap is a screw-on cap that is screwed onto the vessel. Preferably the vessel entrance is closed by the screw-on cap which is distinct from the over-cap. Preferably the screw-on cap comprises aluminium to withstand heat of pasteurization, and the over-cap which is attached to the screw-on cap which is on the vessel after pasteurization of the beverage in the vessel comprises a polymer, preferably moulded into the form of over-cap.

Preferably the beverage container comprises the screw-on cap.

According to another aspect of the invention there is a method of filling a beverage container comprising: an over-cap for capping over a vessel opening; an outer casing to temporarily encase the over-cap and enclosing a reservoir within a tube having a partition intermediate an opening to receive the over-cap and a collapsible portion to change the volume of the reservoir; a nozzle passes through the partition for a beverage to exit the reservoir, wherein the tube is comprised of a reservoir part comprising the collapsible portion and a receiver part comprising the partition; the method including inverting the reservoir part so that its open end opens upwards, urging a beverage into the open end, and joining the receiver part to the open part.

Preferably the reservoir is at least partially filled with the beverage.

While the beverage container is standing upright, a beverage will rest in reservoir with an open space between the beverage and the button. The beverage rests on the partition through which the aperture of the nozzle passes. The beverage container is preferably filled with beverage when the beverage container is inverted so the beverage rests on the button. When the beverage container is turned back upright, there will be a space between the beverage surface and the button which is relatively low pressure compared to the pressure outside the reservoir.

According to another aspect of the invention there is a beverage storage and dispensing system comprising the beverage container described herein and the vessel.

Preferably the beverage container contains the first beverage in the reservoir and the vessel contains the second beverage.

Advantageously, the beverage dispensing system is preferably comprised of parts approved by regulatory authorities for use with food and drink.

Advantageously the beverage dispensing system is economically mass produced, and its components may be preferably manufactured from plastic polymers that can be injection moulded. Polymers approved for use by the authorities are advantageously suitable.

Advantageously, the button is easily sealed to the reservoir part with an automatic machine. The button is moved straight along the central axis of the reservoir part cylinder wall until the button is joined to the container. Preferably the button is joined to the container after the reservoir is filled with a beverage; or also preferably the button is first joined to the container, and then the container is inverted for filling with the beverage.

Typically, fruit juice in a vessel is carbonated and autoclaved. This means that the vessel screw-on cap must withstand autoclaving temperatures over the required time whilst retaining the pressure. Advantageously the beverage dispensing system is compatible with an aluminium screw-on cap which is used, as standard in the trade. A fruit drink may therefore be filled in the vessel and capped and processed by a standard method.

Some polymers which are otherwise suitable for the dispensing system components cannot withstand heat or pressure of a heated and pressurized autoclave. Typically, a glass vessel is filled and then closed with an aluminium screw-on cap before autoclaving the closed vessel. Advantageously the over-cap and article are attachable to the vessel after the vessel is covered by the screw-on cap has been subjected the heat and pressure within the autoclave.

Another alternative is to use an aseptic filling line on a vessel made from plastic material such a PET. Autoclaving may be executed before filling and so a PET vessel and a plastic screw-on cap can be used.

Advantageously an article and an over-cap can be replaced. Hence multiple beverages are dispensable into the vessel.

Advantageously the beverage container is preferably one packaging which can be separated from the vessel before use.

Preferably the beverage container is a vessel augmentation device for containing and dispensing a beverage.

According to another aspect of the invention there is a method of supplying a beverage container with a beverage to be dispensed comprising inverting the reservoir part so that its open end opens upwards, urging a beverage into the open end to put the substance into the reservoir part, snapping the socket onto a rim of the cylinder wall portion of the open end of the reservoir part to seal the beverage into a reservoir.

In a preferable method, the beverage dispensing system is filled with a beverage by supplying the article in two parts. One of the two parts is the reservoir part sealed by the button, and the other of the two parts is the socket screwed onto the over-cap. The reservoir part is inverted so that its open end opens upwards. Then a beverage is urged into the open end to put the beverage into the reservoir part sealed at one end by the button. The socket with over-cap is snapped onto the rim of the open end of the reservoir part to seal the beverage into a reservoir.

Alternatively, the article can be supplied in two parts: one part is a combination of the socket and the reservoir part without a spring or flap for the button; and the second part is the spring or flaps.

In another preferable method of filling the beverage dispensing system, three parts (reservoir, socket, and over-cap) are pre-assembled. The reservoir part is filled from the top, through the space between the spring parts. Then the filled container is closed by sealing the flexible button on top of the cylinder.

The beverage container, and the dispensing system and method described herein comprise features and steps combinable in ways which are industrially applicable. The container and system provide a means enabling steps of the method.

For example, the container is useful to introduce variety of beverages into either another vessel or the vessel to which the container is attachable. The reservoir is arranged to hold a variety of flavours in the form of beverage intended for any beverage category. The variety includes: liquid vitamins, vitality, nutritional compounds and healthy elixir like Echinacea; mood enhancers including but not only alcohol; sugary liquids; spirits for cocktails and mixers; coffee, tea, and other botanical extracts; milk and milk alternative which may be added to coffee or tea which is either hot or especially iced.

Hence advantageously the container and system provide a means for separating a flavouring liquid and storing it in a useful way that enables a consumer to decide on the quantity of flavour or sweetness they want by ejecting from the reservoir into their vessel a quantity of the flavouring liquid that they want. The consumer can even eject from the reservoir into another vessel.

The portion of the body that is adapted to be squeezed or displaced to dispense the beverage from the reservoir may be either the piston or button.

The invention will now be described, by way of example only, with reference to the accompanying drawings in which:

DETAILED DESCRIPTION OF THE INVENTION

Figure 1:
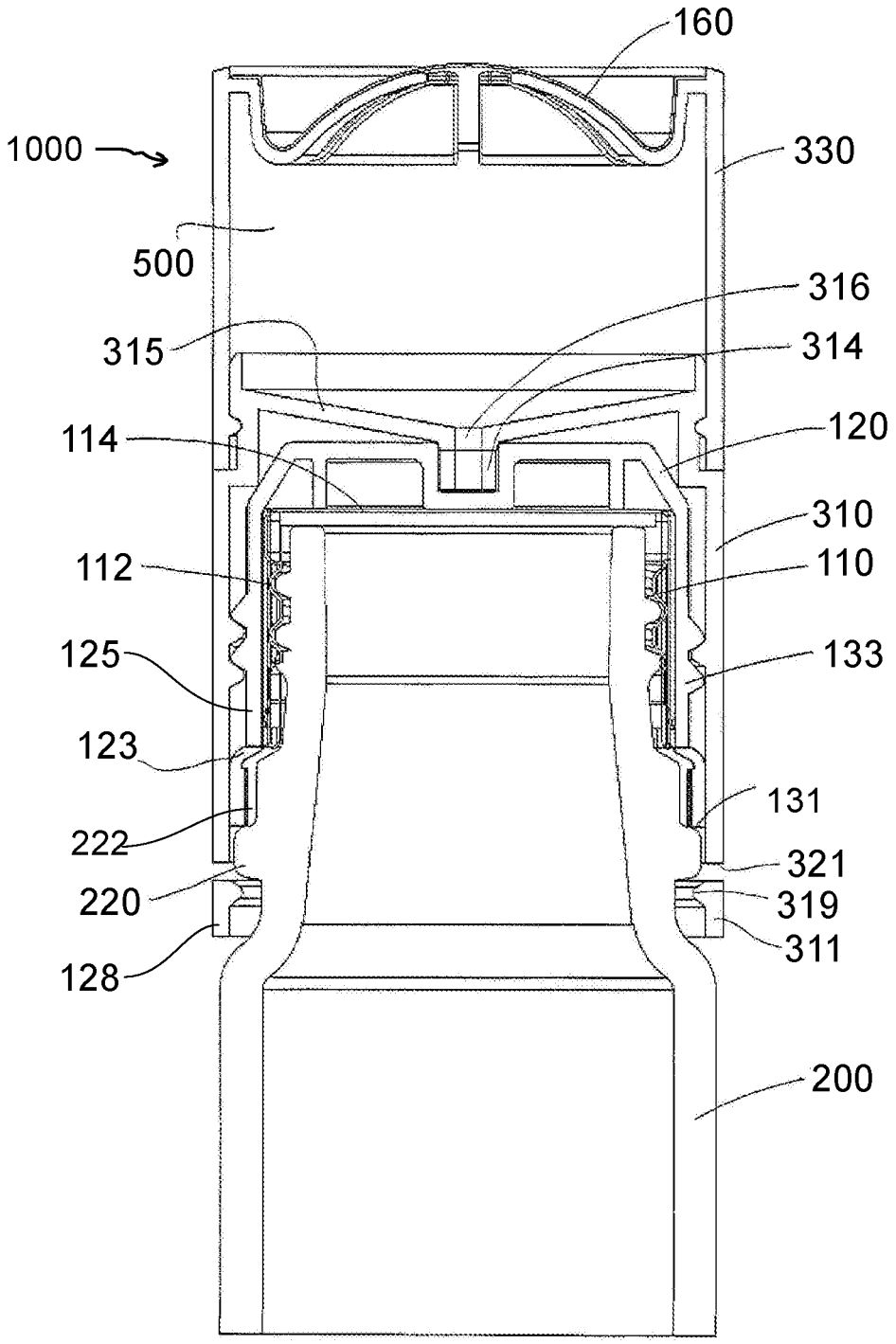
FIG. 1 is a section view showing parts assembled into a beverage container according to the invention.

Referring to the Figures there are shown two embodiments of a beverage container 1000, 11000. The first embodiment 1000 is shown in FIGS. 1 to 10. The second embodiment is shown in FIGS. 11 to 17. Both embodiments comprise: an over-cap 120 detachable from a body. In FIGS. 1 to 17 the body comprises multiple parts assembled together. In the first embodiment the body includes an article 300 of the first embodiment and a collapsible portion comprising button 160. In the second embodiment the body includes an article 1300 of the second embodiment and a piston 600.

In both embodiments, the over-cap detachably connects the body to a drinks vessel 200 and covers an entrance into the vessel 200. A portion of the body is adapted to be squeezed or displaced to dispense a beverage from a reservoir in the body through a passage through the body. In the first embodiment this portion includes the button 160. In the second embodiment this portion includes the piston 600.

Both embodiments are characterised in that the over-cap 120 and a portion of the body which receives and attaches to the over-cap cooperate to hold the over-cap 120 on the vessel as the body is being detached from the vessel 200. In the first embodiment this portion of the body includes a tubular casing of a connecting part to over-cap 313. In the second embodiment this portion of the body includes a portion of the tubular casing of the socket section 1300 proximate the open end 1320.

More specifically there is shown in the Figures for both embodiments a beverage container 1000, 11000 for storage of a first beverage on a neck of a vessel 200 for a second beverage, comprising: an article 300, 1300 in which there is a hollow interior having opposite open ends 302, 1302, 320, 1320 comprising a partition 315, 1315 dividing the interior to form a socket 310, 1310 and a reservoir enclosure 330, 1330, including a nozzle 316, 1316 through the partition 315, 1315. Specifically, in FIGS. 11 to 16 there is shown a piston 600 slid-able in the reservoir 1500. Specifically, in FIGS. 1 to 10 there shown another displaceable portion 160 displaceable in the reservoir 500. In all the Figures the displaceable portion is provided for ejecting a first beverage in the reservoir 500, 1500 into the socket 300, 1300. In all the Figures there is an over-cap 120 for covering the vessel entrance which is a bottle neck opening. The over-cap comprises a shutter 126 on top for shutting the nozzle when the over-cap is received in the socket. In use the portion of the over-cap which covers the vessel entrance is typically the top of the over-cap top because vessel is typically stored with entrance upwards, though this is not required.

It is thereby evident that the integers of the first embodiment in FIGS. 1 to 10 are generally interchangeable with the integers of the second embodiment in FIGS. 11 to 17, except for the integers specific to operation of the button 160 versus the piston 600.

Figure 2:
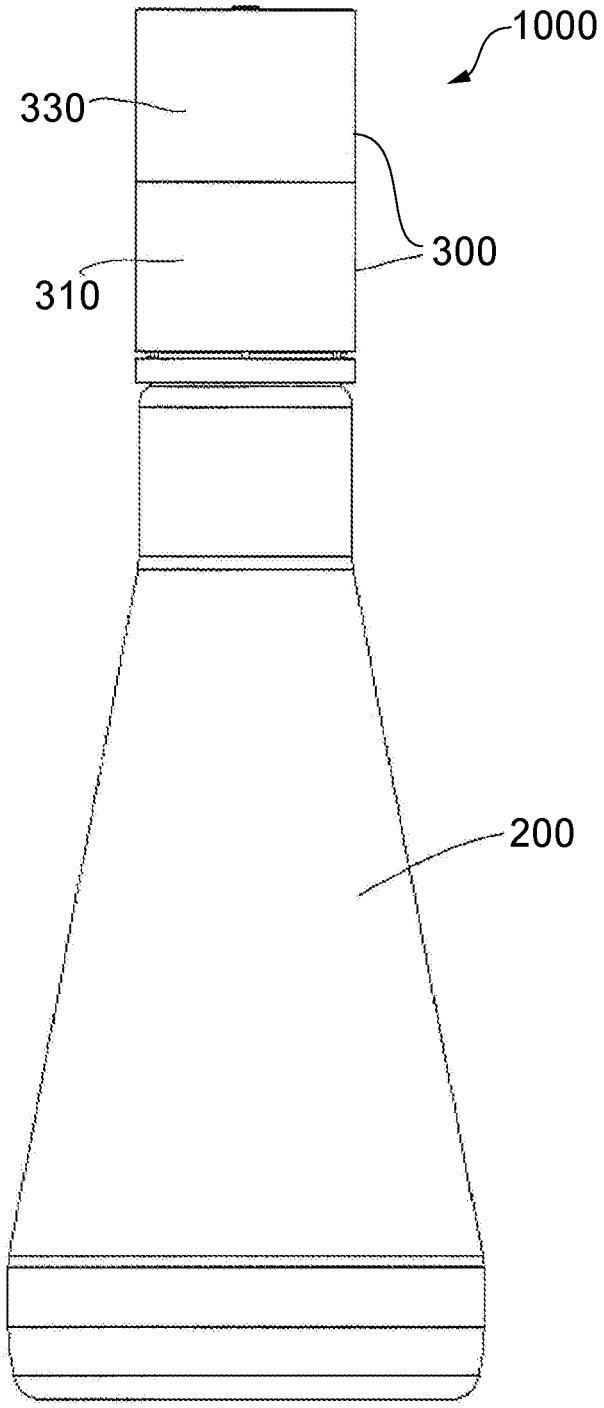
FIG. 2 is a view of an article of a beverage container in situ on a bottle neck according to the invention.
Figure 3:
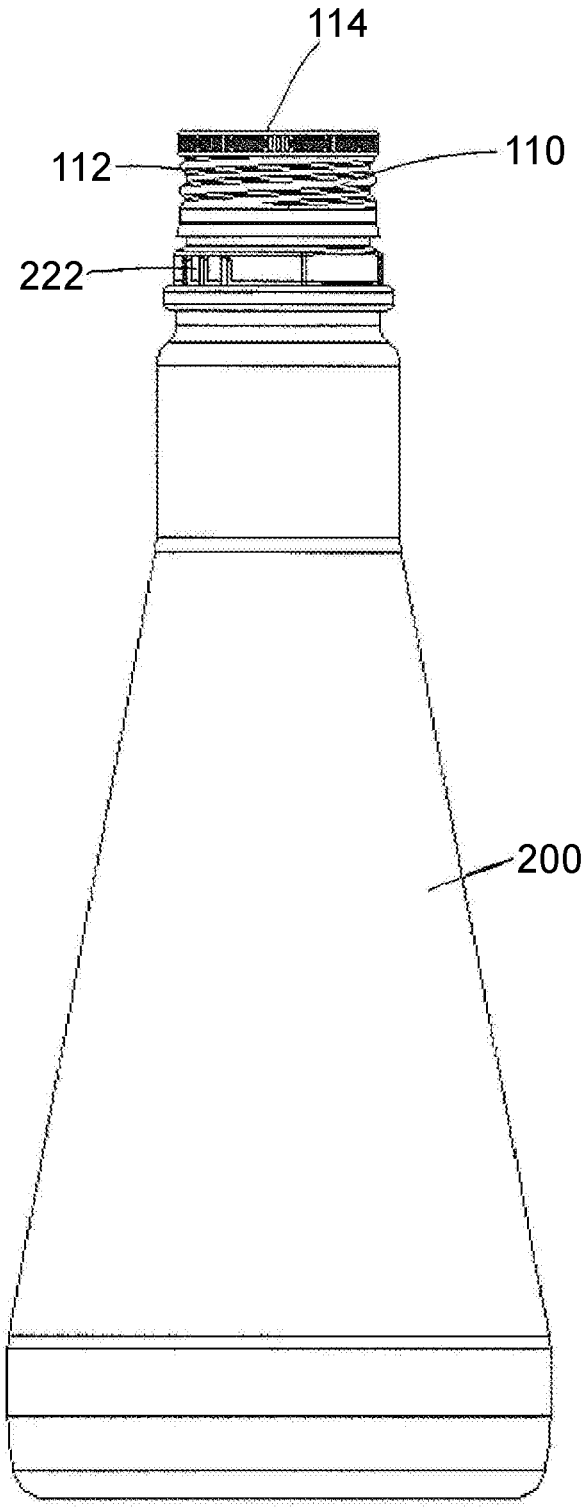
FIG. 3 is a view a vessel cap covering the opening of a bottle neck according to the invention.
Figure 4:
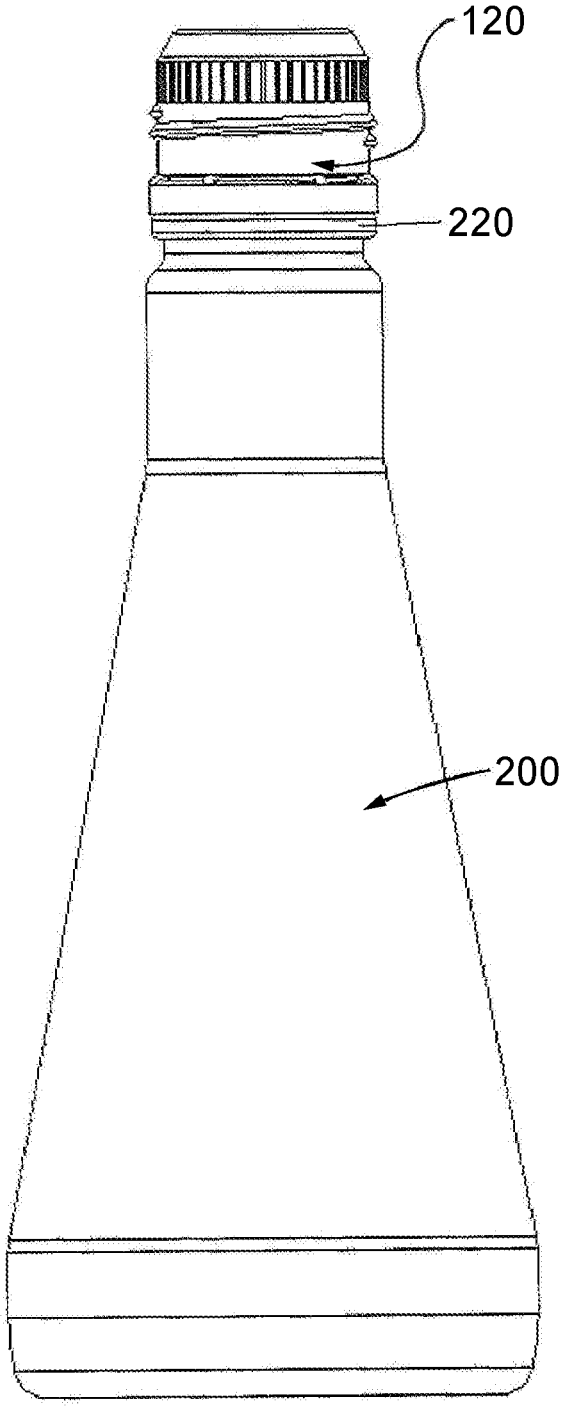
FIG. 4 is a view of an over-cap covering the vessel cap in situ on a bottle neck according to the invention.
Figure 5:
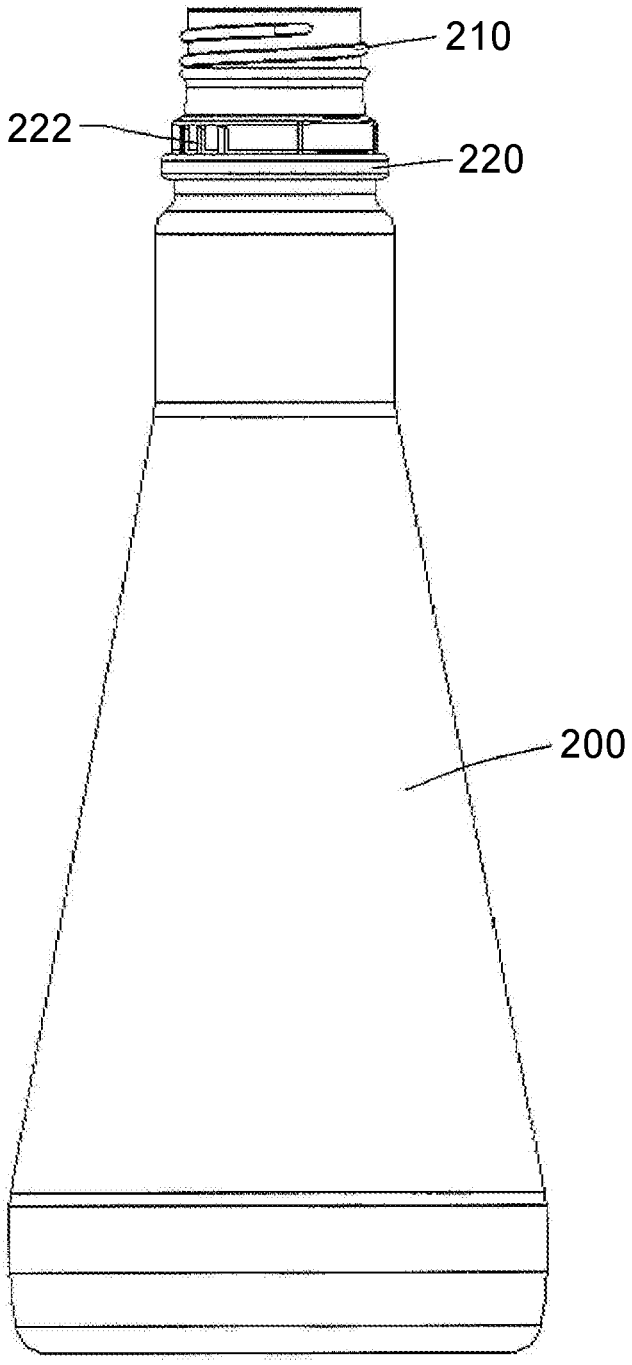
FIG. 5 is a side view of a bottle having a bottle neck to receive a liquid container according to the invention.

There is shown in FIG. 1 a section view and in FIG. 2 a view of the exterior of an outer casing of the article 300 of a beverage container 1000 fitted to a vessel 200 in the form of a bottle. The liquid container, comprises: an over-cap 120 for capping over a bottle opening; an article 300 including an outer casing to temporarily encase the over-cap 120 and enclosing a reservoir 500 within a tube having a partition 315 intermediate an opening to receive the over-cap 120 and a collapsible portion 160 to change the volume of the reservoir 500; a nozzle 315 passes through the partition 315 for a liquid to exit the reservoir.

As shown in FIGS. 1, 2, 11, and 12 the article 300, 1300 is formed of a tube or tubular outer casing and a partition 315, 1315. The tube or tubular outer casing includes a reservoir enclosure section 333,1333 intermediate the partition 315, 1315 and the piston 600 or button 160. The tube or outer casing also includes a socket section 310, 1310 intermediate the partition and a 1321 of the socket. The article also comprises the partition 315, 1315 dividing the hollow interior.

Screwed onto the neck of the bottle is a vessel cap 110. The vessel cap has a top 114. The over-cap 120 covers the vessel cap 110. The socket 310 covers the over-cap 120. The vessel cap is a screw-on cap.

Figure 11:
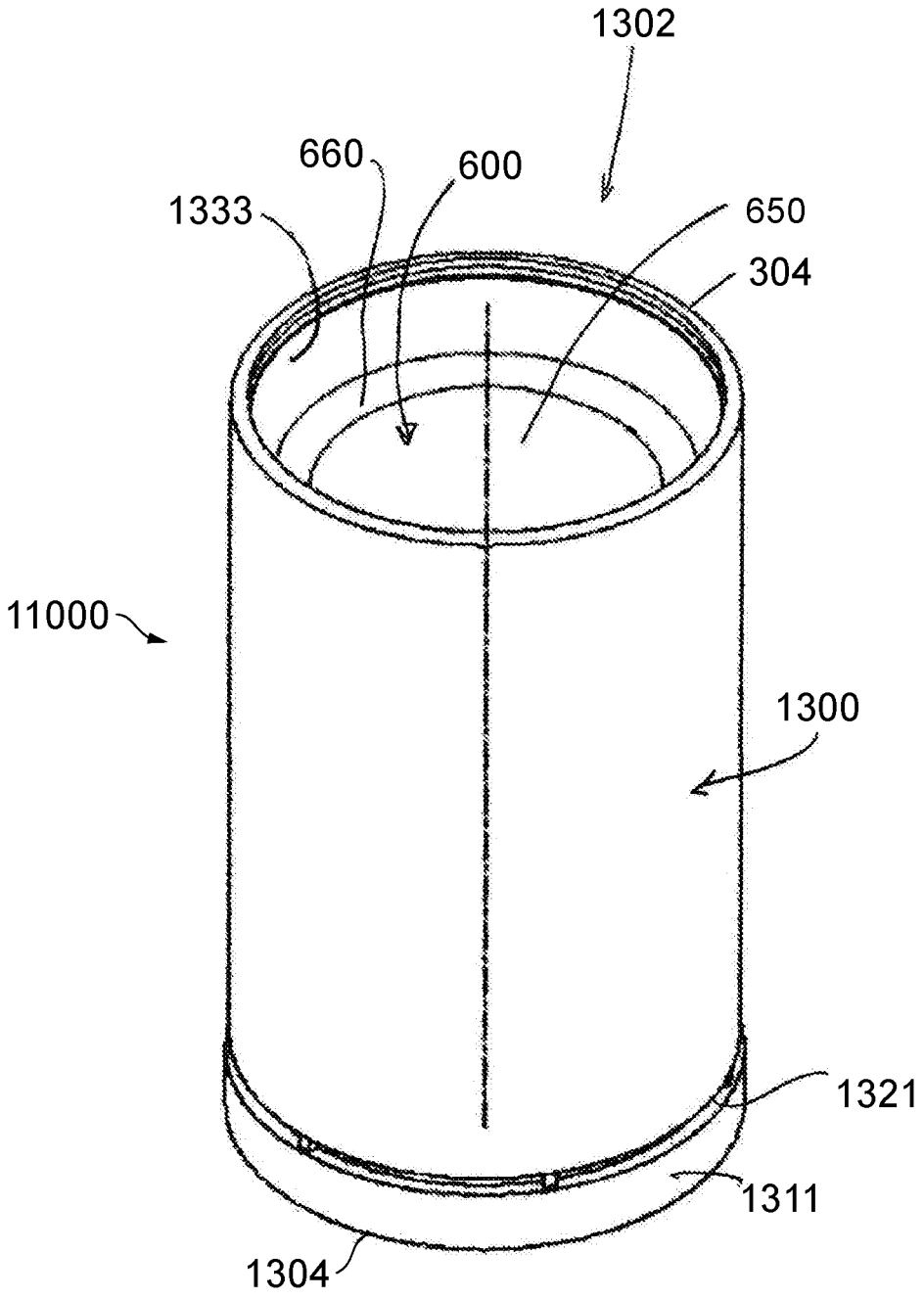
FIG. 11 shows an isometric view of the exterior of a liquid container comprising a piston type dispensing portion.

In FIGS. 1 and 2 the article 300 comprises a socket 310 to connect to the over-cap and a reservoir part 330, although this is not essential because the article 300 may be a single unit as shown in FIG. 11. The socket 310 is snap connected to the reservoir part 330.

The article 300 comprises a tubular wall 313, 333 visible in FIG. 8 and FIG. 9. The tubular wall part of the outer casing which with the partition 315 forms the article 300.

The outer casing of the article 300 has an open end 302 of the reservoir enclosure 330 which is closed off by the collapsible portion to close the reservoir. The outer casing 300 has a distal open end 320 to receive the over-cap 120 on the bottle neck.

The collapsible portion 160 comprises a flexible button which may pushed to eject the liquid. When the button is pushed it flexes and is depressed into the reservoir to change the reservoir volume.

The article 300 is closed at the end 302 by the depressable button 160 which forms the collapsible portion. The button is visible in FIG. 1 and FIG. 10.

The interior surface of the tubular wall is cylindrical for screwing onto a cylindrical bottle neck. Although not essential, the outer casing of the article 300 comprises a cylindrical tube.

The outer casing of the article 300 has an open end to receive the over-cap 120, and a base 315 which forms the partition. The base 315 closes the cylinder wall 313 from within the tube. The base forms a boundary of the reservoir 500. The base 315 is at the distal end from the opening in the outer casing 320 to receive the over-cap.

A nozzle protrusion 314 extends from the base 315. Although not essential, the nozzle protrusion is located at the axial centre of the outer casing and extends axially. The nozzle is sealed by connection with the over-cap 120. The nozzle 316 is visible in FIG. 1 and FIG. 8.

The button 160 is depress-able into the reservoir 500 to change the volume of the reservoir. Depressing the button urges any liquid in the reservoir 500 out through the nozzle 314. However, until the socket 310 of the article 300 is disconnected from the over cap 120 any beverage within the reservoir 500 cannot escape because the nozzle is sealed by a shutter connection with the over-cap 120.

The bottle 200 has neck proximate the bottle opening. The neck has a screw-thread 210 to engage the screw-on cap 110. The screw-thread is located intermediate the bottle opening and a circumferential ridge 220 on the neck.

The screw-on cap 110 also has a screw-thread 112 to engage with the screw-thread 210 on the neck of the bottle.

An over-cap 120 covers the bottle neck and bottle opening. The over-cap 120 also covers the screw-on cap 110 screwed onto the neck. The over-cap 120 is visible in FIG. 1, FIG. 4, and FIG. 7.

The over-cap 120 has a form of an open-ended cylinder with a first rim 123 of the open end.

Figure 7A:
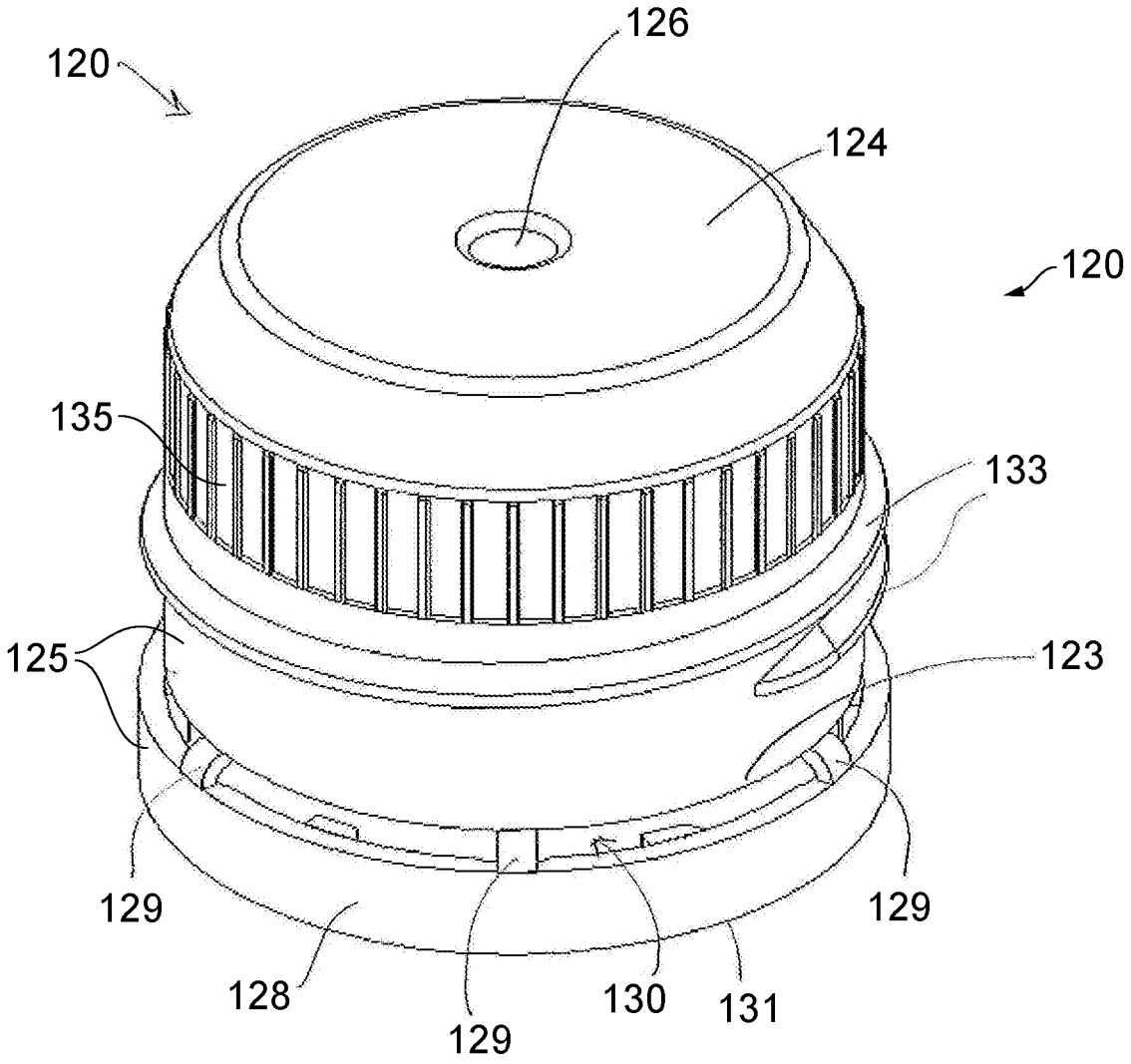
FIGS. 7A, 7B, and 7C are views of the outside, inside, and cross-section respectively of an over-cap according to the invention.
Figure 7B:
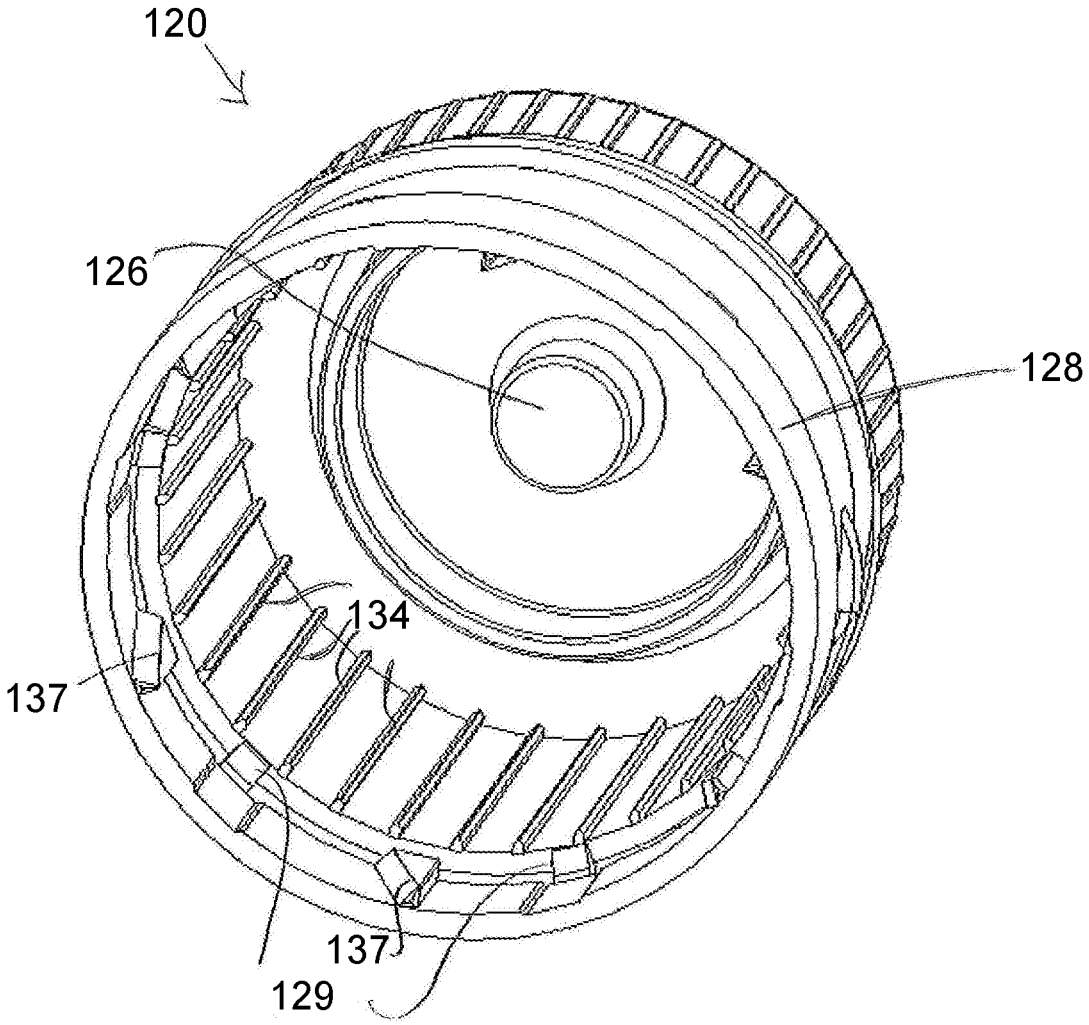
Figure 7C:
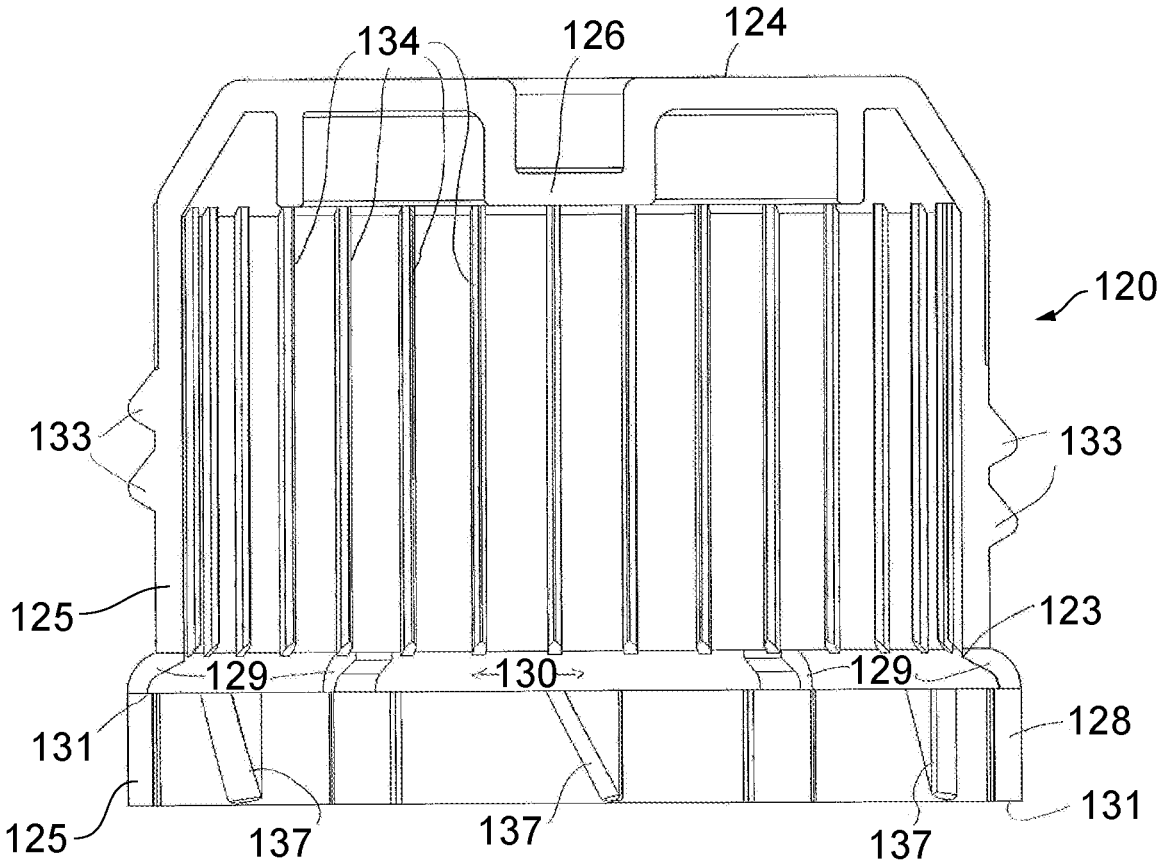

As shown in FIGS. 7B and 7C there are axially aligned ribs 134 on the inner surface of the cylindrical wall of the over-cap 120. The ribs 134 of the over-cap 120 grip the cylindrical wall of the screw-on cap so that the screw-on cap is unscrewed from the bottle together with the over-cap 120.

As shown in FIG. 7B, the axially aligned ribs extend from the portion of the over-cap which cover the entrance into the vessel to proximate the first rim 123 of the over-cap. Although not shown in FIG. 7B, the over-cap may also be provided with the axially aligned ribs extending from proximate the portion which covers the entrance to approximately mid-way between the portion which covers the entrance and the first rim 123.

The over-cap has a top 124 which closes one end of the open-ended cylinder. The top 124 is therefore at the distal of the open-ended cylinder from the first rim 123.

The over-cap top 124 has the shutter in the form of a central depression 126 in the top of the over-cap.

The nozzle protrusion 314 is extracted from the central depression 126 when the over-cap 120 is removed from the socket 310. So, the shutter unblocks the nozzle 316 when the over-cap 120 is removed from the socket 310.

The central depression 126 is urged into contact with the top 114 of the screw-on cap when the over-cap is secured to the neck of the bottle.

The over-cap 120 protects the top 114 of the screw-on cap from damage. The central depression comprises a portion which intervenes between the nozzle and the top 114 of the screw-on cap. The portion shields the top from damage by the nozzle if the nozzle is deflected downward by overpressure in the reservoir as the button is depressed.

The over-cap fits tightly on to the top 114 of the screw-on cap to stop any rotating movement over the screw-on cap.

The over-cap 120 also comprises a separate ring 128 having a circumference with which greater than the circumference of the first rim 123. The separate ring 128 is separated from the first rim 123 by a circumferential gap 130. The separate ring 128 is connected to the first ring by fingers 129 across the circumferential gap 130.

The separate ring 128 provides the over-cap 120 with a second circumferential rim 131 which located more distal from the top 124 of the over-cap 120 than the first rim 123.

The separate ring 128 fits over radially raised locks 222 on the bottle neck which are lugs on the bottle neck. The separate ring has locking protrusions 137 which come up against the raised locks 222 on the bottle neck and will prevent any turning of the over-cap when the outer case 300 is being unscrewed from the over-cap.

Although the raised stops are shown in FIGS. 7B and 7C this is not essential. The over-cap 120 comprises a skirt 125 which comprises the separate ring 128. The skirt 125 is joined to the circumference of the top 124 of the over-cap 120. The skirt has a first lock device 137 which is the locking protrusion. The first lock device 137 engages with a second lock device 222 on the vessel. The second lock device is the raised lug 222 on the bottle neck. When over-cap 120 is pressed or screwed onto the vessel neck and the first and second lock device are engaged they prevent twisting of the over-cap.

The skirt 125 comprises a resilient material which permits the skirt to expand radially to disengage the first lock from the second lock when a preselected torque is applied to the over-cap.

The over-cap 120 can only been unscrewed from the bottle after the socket 300, 1300 has been unscrewed from the over-cap 120.

When the over-cap 120 is screwed into the socket 310, 1310, the tubular casing 313, 1313 of the socket 300 covers the over-cap 120.

As mentioned above, the first and second locking devices 137, 222 engage the over-cap 120 with the bottle neck and prevent the over-cap 120 from unscrewing and becoming accidentally unscrewed.

The skirt 125 including the separate ring 128 of the over-cap can only 'jump' over the lugs 137 when the separate ring is free to expand to a larger diameter. The tubular wall 313 of the socket 310, 1310 encircles the over-cap 120 and prevents the over-cap from expanding. This prevents the first lock 137 from disengaging from the second lock 222 because the lugs 137 on the skirt of the over-cap cannot jump over the lug 222 on the neck of the bottle. The lug 222 is a raised ridge which locally increases the diameter of the bottle neck.

Figure 6:
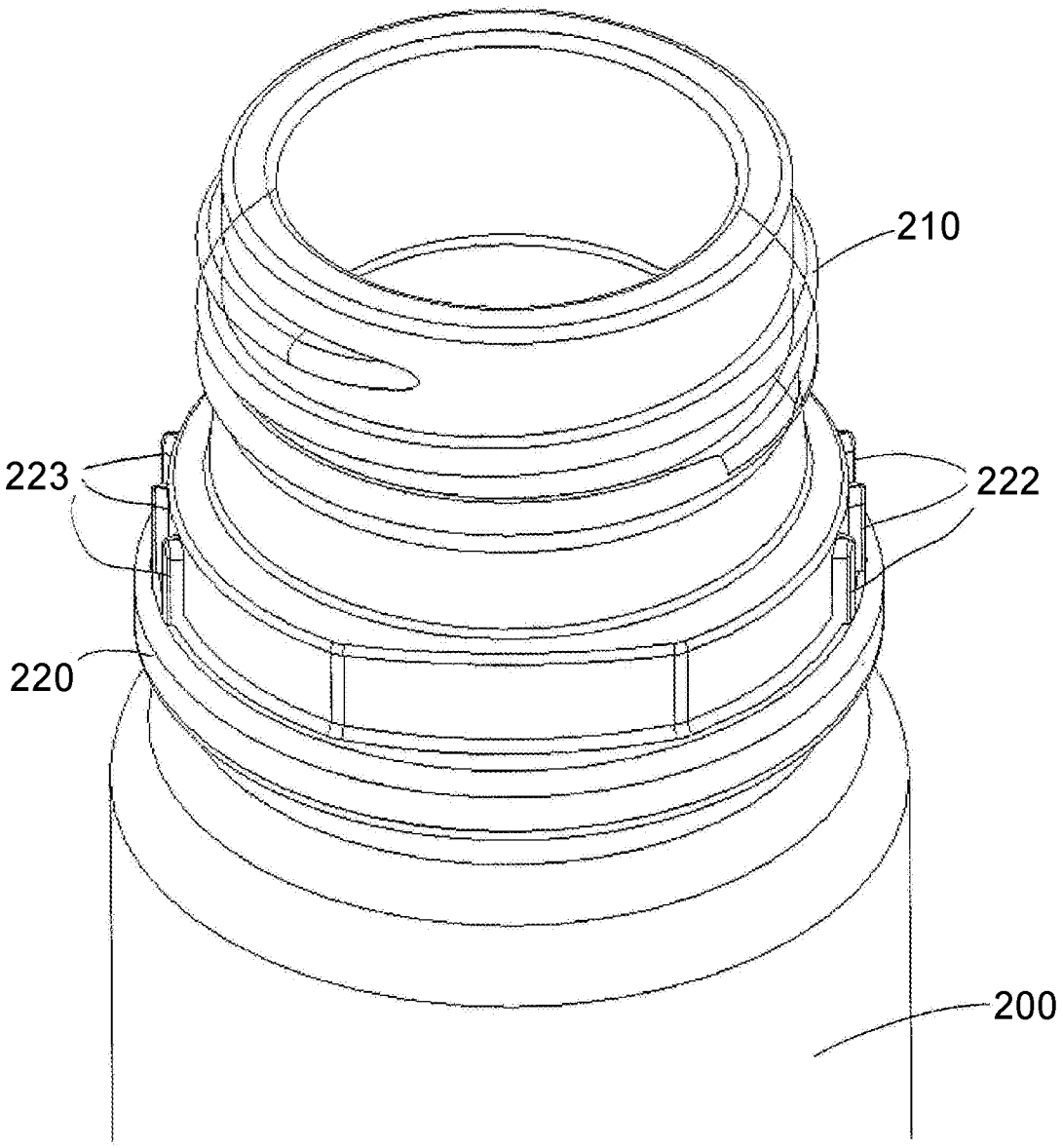
FIG. 6 is a is a view into an opening of a bottle having a bottle neck to receive a liquid container according to the invention.

Although not essential, the effectiveness of the lug is improved by being one of a plurality of circumferentially adjacent raised stops 222 which are axially aligned with the bottle neck axis as shown in FIG. 6. Although not essential, the effectiveness of the lug 222 is doubled by including a diametrically opposite lug 223 on the bottle neck to engage with a second lug on the over-cap which diametrically opposite to opposite to the first lug 137 on the over-cap.

As the outer case 300 is removed from the over-cap 120 the shutter 126 unblocks the nozzle opening 316, 1316. So, the seal between the nozzle protrusion 314, 1314 and the over-cap 120 is also removed. The outer case is thereby readied to dispense any liquid within the reservoir through the nozzle by collapsing the collapsible portion, which is effected by depressing the button 160 or piston head 600.

The over-cap 120 seats onto the screw-on cap. The central depression 126 on the top of the over-cap 120 is screwed into contact with the top 114 of the screw-on cap 110. So, the inside top of the over-cap 120 at the bottom of the depression 126 contacts the top of the screw-on cap 110 when assembling. Clearance space remains between the separate ring 128 and the circumferential ridge 220 on the neck of the bottle.

The central depression 126 is a sink in the center of the top 124 of the over-cap 120. The central depression accepts the nozzle defined by the protrusion 314 and aperture 316 protruding from the partition 315 which forms a base of the socket 310. The nozzle is 316 is sealed into the central depression.

The central depression seals around the protrusion 314 of the nozzle and acts as a hermetic seal to stop any ingress of oxygen which will degrade a liquid in the bottle or reservoir over time and any loss of liquid from the reservoir due to an extended shelf life or aggressive handling.

The seal also prevents the first beverage in the reservoir 500 from being dispensed, even if a dispenser for ejecting the first beverage from the reservoir 500, such as the button 160 or piston 600 is depressed.

Protruding inwards from the internal side of the separate ring 128 is a lug 137. The lug protrudes inwards toward the centre of the ring. The tooth 137 extends from the second rim 131 of ring 128 to the edge of the ring 128 adjacent to the circumferential gap 130. Another lug 222 on the neck of the bottle on the side of the bottle screw-thread and distal from the bottle opening engages the lug 127 on the separate ring when the over-cap 120 is fully screwed on the bottle.

On the external side of the cylinder portion of the over-cap 120 is an external screw thread 133. The external screw-thread 133 traverses one turn around the external side of the cylinder portion. The external screw-thread 133 engages an internal screw thread 318 on a socket 310 of the 300, wherein the part 310 is connectable and disconnectable from the over-cap 120.

The article 300 can be unscrewed from the over-cap 120, thereby breaking the tamper evident break-away ring 311 because of circumferential ridge 220 the bottle neck. The break-away ring 311 remains on the bottle.

The article along with the first beverage in the reservoir cannot be released from the vessel without leaving the break-away ring behind on the neck. So, tampering would be evident.

Removing the article 300 releases the nozzle protrusion 314 from the shutter 126. The beverage container 1000 minus the over-cap 120 is then ready for ejecting the first beverage from the reservoir 500 into any space.

While unscrewing the article 300 from the bottle 200 the over-cap 120 will be blocked from turning because of the tooth 137 on the separate ring 128 of the over-cap 120 and corresponding tooth 222 on the bottle neck. The cylinder wall covering the bottom ring of the over-cap 120 prevents the tooth 137 on the separate ring 128 slipping over the corresponding tooth 222 on the bottle neck.

After the outer casing 300 has been unscrewed from the bottle, the over-cap is left on the bottle.

The first lock device, lug 137 in the over-cap can jump over the second lock device, lug 222 on the bottle once the article 300 is removed. It is then possible to unscrew the over-cap 120 and the screw-on cap inside this over-cap 120. When unscrewing the exposed over-cap 120 that is locked to the screw-on cap, the over-cap 120 unscrews the screw-on cap 110 from the bottle 200 in the normal way.

The outer casing of the socket 310 covers the screw-on cap 110 and the outer cap 120. The tubular outer casing 313, 333 of the article 300 socket 310 and reservoir enclosure 330 is visible on the bottle neck covering the bottle opening as shown in FIG. 2. The screw-on cap 110 and the outer cap 120 cannot be seen unless the outer casing 300 is transparent.

The article 300 comprises a socket 310 for the over-cap 120 and a reservoir part 330. The socket 310 is snap connected to the reservoir part 330.

The general form of the socket 310 for the over-cap is an open-ended cylinder with a cylindrical wall 313, one end closed by a base 315 and the distal end open. There is a circumferential slot 312 around the top rim of the cylindrical wall 313.

The general form of the reservoir part 330 is an open-ended cylinder with one end an open separated by a cylinder wall 333 from the other end. The other end is partially closed by flexible flaps 335.

Proximate the open-end rim of the reservoir part 330 is a circumferential ridge 332. The circumferential ridge 332 is snapped into the circumferential slot 312 of the socket 310 for the over-cap 120, thereby connecting the socket 310 for the over-cap 120 to the reservoir part 330. A reservoir 500 bounded by the base 315 of the socket 310 for the over-cap and the cylindrical wall of the reservoir part 330 is thereby formed.

The cylindrical wall of the reservoir part 330 is resiliently flexible for the circumferential ridge 332 to be snapped into the circumferential slot 312. A liquid tight seal is thereby formed.

The reservoir part 330 and the socket 310 for the over-cap comprise a polymeric material as does the over-cap 120. Other materials may also be used such as metallic materials.

These materials are flexible. Separate ring 128, break-away ring 311, and flexible flaps 335 can stretch and bend and can spring to move back to their original position when bent or stretched.

The collapse-able portion 160 may be repeatedly pumped to pump the liquid out through the nozzle. Each time the collapse-able portion is depressed to pump liquid out of the reservoir it is urged to spring back to the undepressed position by the flexible flaps 335 which are resilient.

As the collapse-able portion springs back, air is drawn in through the nozzle and into the reservoir. The air helps pump the liquid out of the reservoir when the collapse-able portion depressed.

The cylindrical wall 313 of the socket 310 for the over-cap has the same diameter as the cylindrical wall 333 of the reservoir part 330.

The socket 310 for the over-cap comprises a break-away ring 311 having the same diameter as the cylindrical wall 313 of the socket.

The cylindrical wall 313 of the socket has an inner diameter the same as the outer diameter of the circumferential ridge 220 on the neck of the bottle 200.

The length of the cylindrical wall 313 is sized such that the socket 310 for the over-cap is screwed onto the over-cap 120 until it is blocked by the nozzle axial protrusion 314. The rim of the open end 321 of the cylindrical wall 313 extends to the circumferential ridge 220 of the bottle neck.

The break-away ring 311 is joined by fragile stringers 317 to the rim of the open end 321 of the cylindrical wall 313. The break-way ring 311 is separated from the rim by a cylindrical gap.

The break-away ring 311 comprises a dimple or circumferential ridge 319 extending radially inwards. The dimple or ridge 319 extends radially inward further than the diameter of the circumferential ridge 220 on the neck of the bottle.

The fragile stringers 317 are resiliently flexible to allow the break-away ring 311 including the circumferential ridge 319 to temporarily stretch over the circumferential ridge 220 on the neck of the bottle.

When the socket 310 for the over-cap 120 is screwed onto the over-cap 120 the break-away ring 311 is driven over the circumferential ridge 220. The break-away ring 311 then snaps back. The socket 310 for the over-cap 120 cannot be removed without breaking the fragile stringers 317 because the dimple or circumferential ridge 319 on the break-away ring is blocked by the circumferential ridge 220 on the bottle.

The outer casing 300 is only removable from the bottle by breaking the fragile stringers 317 and leaving the break-away ring 311 behind on the bottle. This is because the outer casing 300 comprises the socket 310 for the over-cap 120 and a reservoir part 330 snapped together.

The base of 315 of the socket 310 for the over-cap 120 is a partition which blocks closed the open end of the reservoir part 330. The base 315 is the bottom of the reservoir 500 formed by the reservoir part 330 being snap connected to the socket 310 for the over-cap 120.

Figure 8A:
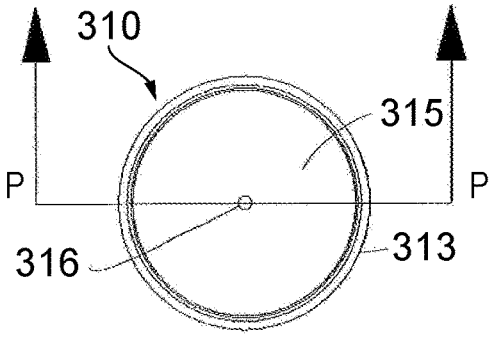
FIGS. 8A, 8B, 8C, 8D, 8E, and 8F are views of the top, cross-section, outside, inside, side, and bottom respectively of a socket according to the invention.
Figure 8C:
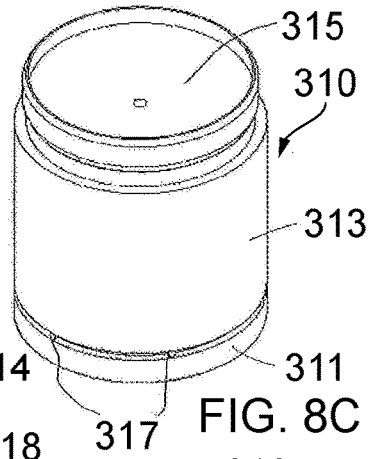
Figure 8E:
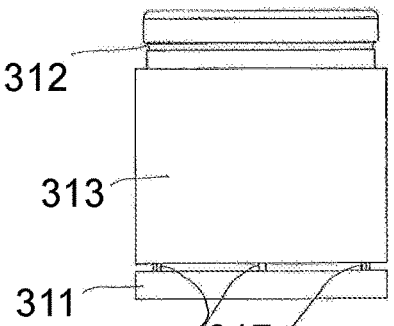
Figure 8B:
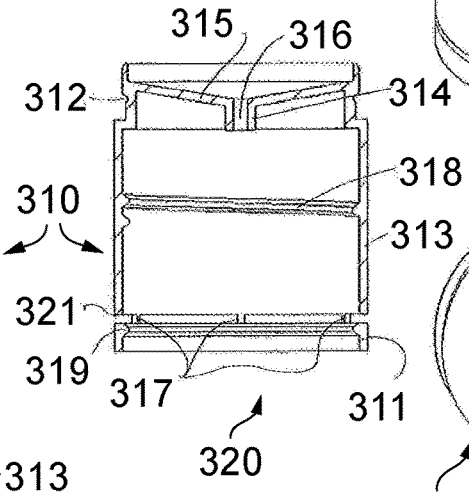
Figure 8D:
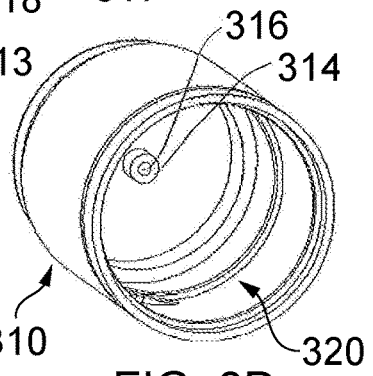
Figure 8F:
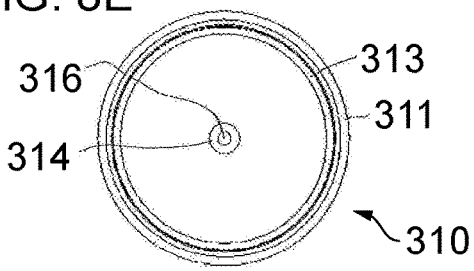
Figure 9B:
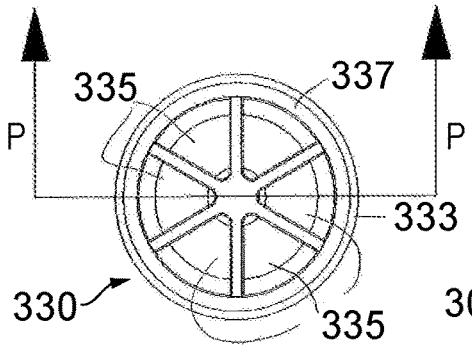
FIGS. 9A, 9B, 9C, 9D, 9E, and 9F are views of the outside, top, cross-section, side, inside, and bottom respectively of a reservoir part according to the invention.
Figure 9A:
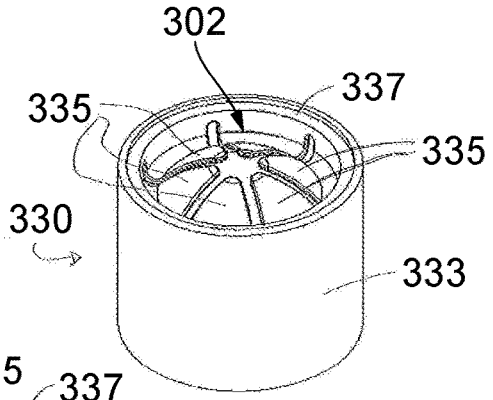
Figure 9D:
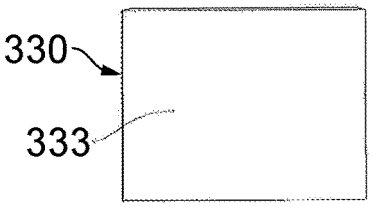
Figure 9C:
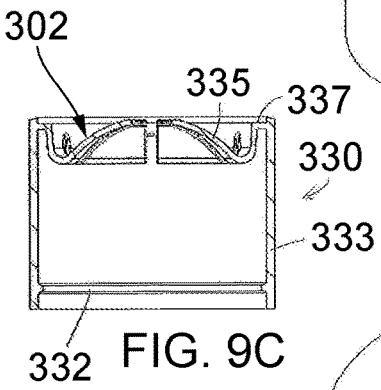
Figure 9F:
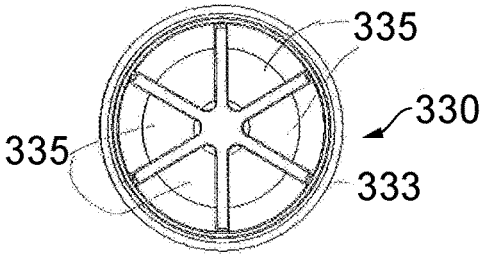
Figure 9E:
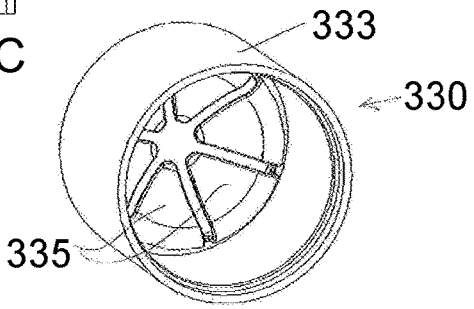
Figure 10A:
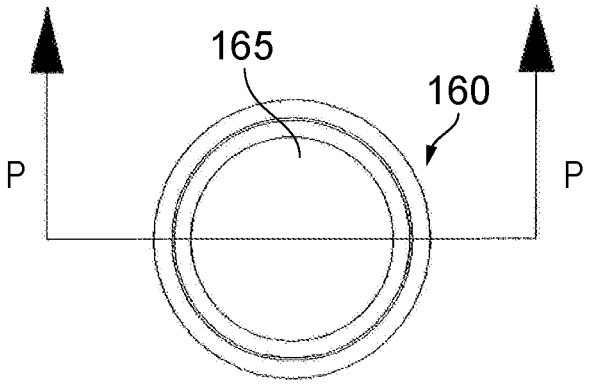
FIGS. 10A, 10B, 10C, 10D, 10E, and 10F are views of the top, cross-section, outside, side, bottom and inside respectively of a button according to the invention.
Figure 10C:
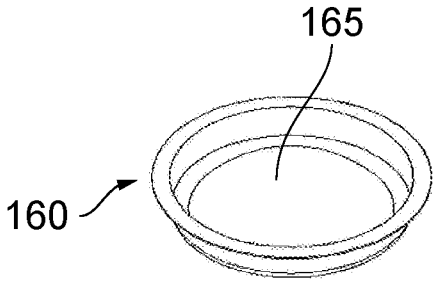
Figure 10D:
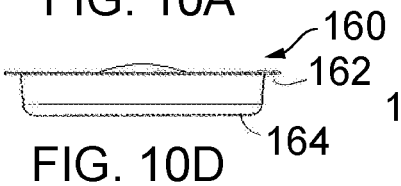
Figure 10B:
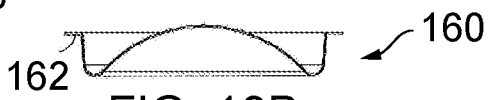
Figure 10E:
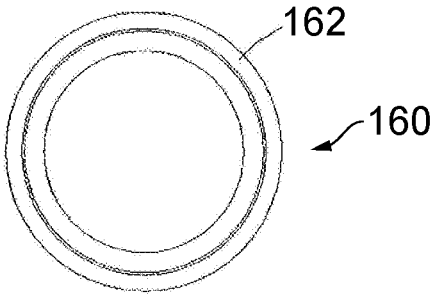
Figure 10F:
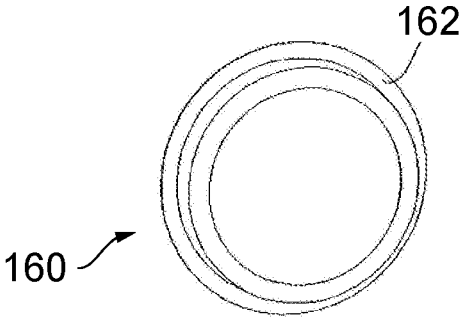

The base 315 of the socket has a general form of a circular plate. The base 315 is slightly conical as shown in FIG. 1 and FIG. 8B to more easily empty all the liquid from the reservoir 500.

At the center of the base 315 is a nozzle axial protrusion 314. The nozzle axial protrusion 314 extends into the hollow interior of the socket 310 for the over-cap 120.

The nozzle axial protrusion 314 has an aperture 316. The aperture 316 extends through the base 315 of the socket. The aperture 316 provides an escape conduit out of the reservoir 500 for a liquid within the reservoir 500.

There is an internal screw-thread 318 on the cylinder wall of the socket 310 for the over-cap 120. The internal screw-thread 318 is located intermediate the base 315 and the open end 320 of the cylinder wall 313. The internal screw-thread 318 traverses a single turn around the interior of the cylinder wall 313.

The socket 310 for the over-cap 120 is connected to the over-cap 120 by inserting the top of over-cap 120 into the socket 310. The socket is then screwed onto the over-cap 120 so that the internal screw-thread 318 engages the external screw-thread 133 of the over-cap. The socket 310 for the over-cap 120 may be screwed until the axial protrusion 314 contacts the seal of the depression 126 in the over-cap top 124.

The axial protrusion 314 fits into the central depression 126 of the over-cap 120. The axial protrusion 314 of the base 315 of the socket is set against the over-cap central depression 126. The base 315 forms a partition between the reservoir 500 interior of the outer casing and the open end of the outer casing. The over-cap central depression 126 is in turn set against the top 114 of the screw-on cap 110.

The protrusion 314 and aperture 316 form a nozzle to direct a stream of liquid out of the reservoir. The nozzle is a specific diameter and length so that when the button 160 returns to its start position after ejecting liquid, gas will be drawn back into the reservoir through the nozzle and no liquid will drip from the nozzle. At this position of the button the remaining liquid in the reservoir cannot escape as the liquid is blocking the aperture 316 nozzle opening and therefore entry to gas usually air. In use, the liquid container is usually removed from the bottle when button 160 is operated. So, when the button returns to its start position, air from outside the container is drawn back into the reservoir.

As an alternative to the open nozzle aperture 316 shown in FIG. 8, the nozzle comprises a 2-way valve to block the aperture.

'To open the bottle, the outer casing 300 is removed by unscrewing and breaking the fragile stringers 317. The over-cap 120 and screw-on cap 110 are unscrewed from the bottle opening.'

After being assembled the over-cap 120 and screw-on cap 110 stay connected. The vertical ribs 134 in the over-cap 120 inner wall shown in FIGS. 7B and 7C mesh with the ribs on the top end of the vertical cylinder of the screw-on cap 110 shown in FIG. 3. The meshed ribs transfer the turning force on the over-cap 120 when unscrewing to the screw-on-cap 110.

The reservoir enclosure 330 and the socket 310 are formed by the outer casing 313, 333 of the article 300 divided by the partition 315.

The end 302 of article 300 comprising the reservoir enclosure 330 around the reservoir 500 is distal and opposite to the end 320 of article comprising the socket 310. When the article 300 is covering the bottle opening, the reservoir enclosure 330 is distal from the bottle opening. The open end of the outer casing is closed by the partition 315.

The end of the outer casing most distal from the open end of the outer casing comprises a circumferential seat 337. The seat 337 extends from the inner surface of cylinder wall into the reservoir. The seat 337 has a smooth surface facing outwards from the reservoir. The smooth surface is arranged to form a sealed joint to a sealing surface.

When the outer casing 300 comprises a socket for the over-cap and a reservoir part 330, the reservoir part comprises the seat 337.

The end of the outer casing 300 most distal from the bottle comprises the end of the reservoir part partially closed by flexible flaps 335. The flexible flaps 335 extend radially inwards from a smooth seat 337 on the inner surface of the cylinder wall 333.

The collapsible portion has a circumferential sealing surface 162 around the button 160. The sealing surface is seated onto the smooth seat 337. A seal to the button is achieved by inserting the button 160 into the end of the outer casing comprising the flaps 335 until the circular sealing surface is sealed against the smooth seat 337. The circumferential perimeter of the button is fixed at the end of the outer casing and permanently located there.

The flaps 335 are directly underneath and in contact with the top flexible button. There are six upwardly curved moulded flaps 335 with spaces in between. As the flexible button 160 is pressed down, so are the moulded flaps. As the flaps 335 are a moulded part of the reservoir part 330 extending from the cylinder wall 333 and are made from an injection moulded polymer which has a stiffness and memory, the flaps 335 act as a spring, increasingly resisting the downward pressure on the button until no further travel is possible. At this point the spaces between the flaps have disappeared also stopping any further movement downwards.

This amount of travel of the depressed button defines the volume of the dose of liquid from the reservoir into the bottle. The spring effect of the flaps returns the flexible button to its original position ready for the next dose.

The reservoir 500 bounded by the base 315 of the socket 310 for the over-cap 120 and the cylindrical wall of the reservoir part 330 is thereby enclosed by the button 160. The reservoir is sealed liquid tight.

The button 160 has a flexible convex rise from the circular sealing surface to the button center. Depressing the flexible convex rise over-pressurizes a liquid in the reservoir 500.

The distal wall of the reservoir 500 from the button 160 is the base 315 of the socket 310 for the over-cap 120.

FIGS. 11, 12, 13, 14, 15, and 16 illustrate an article 1300 and a piston 600 for a beverage container 11000. However, the complete beverage container 11000 is not shown in FIGS. 11 to 16 because the beverage container comprises an over-cap 120 shown in FIGS. 7A, 7B, and 7C which is not shown in FIGS. 11 to 16.

Figure 12:
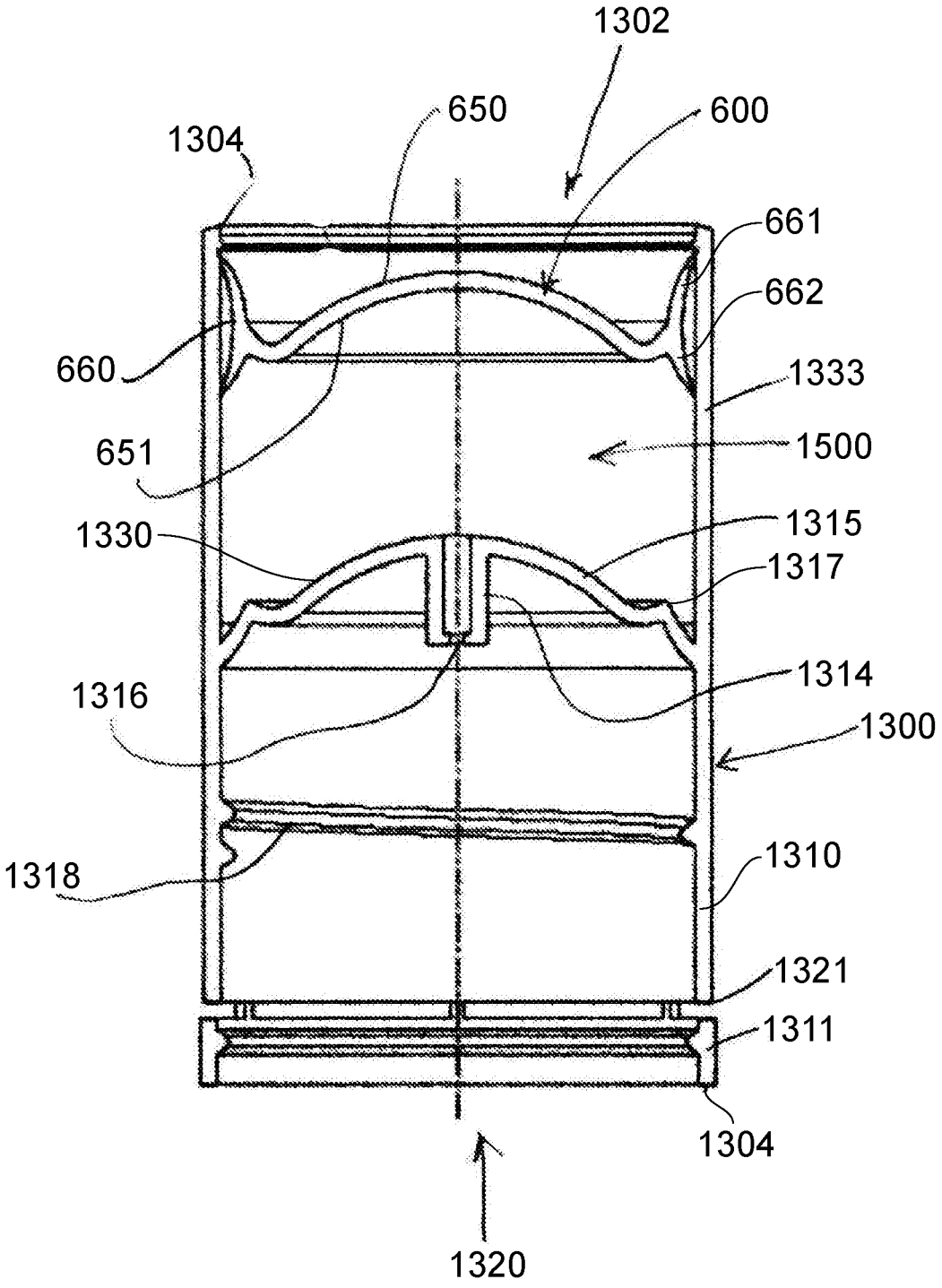
FIG. 12 shows a cross section of the liquid container in FIG. 11 wherein the piston is located most distal from the partition and reservoir is at maximum volume.
Figure 13:
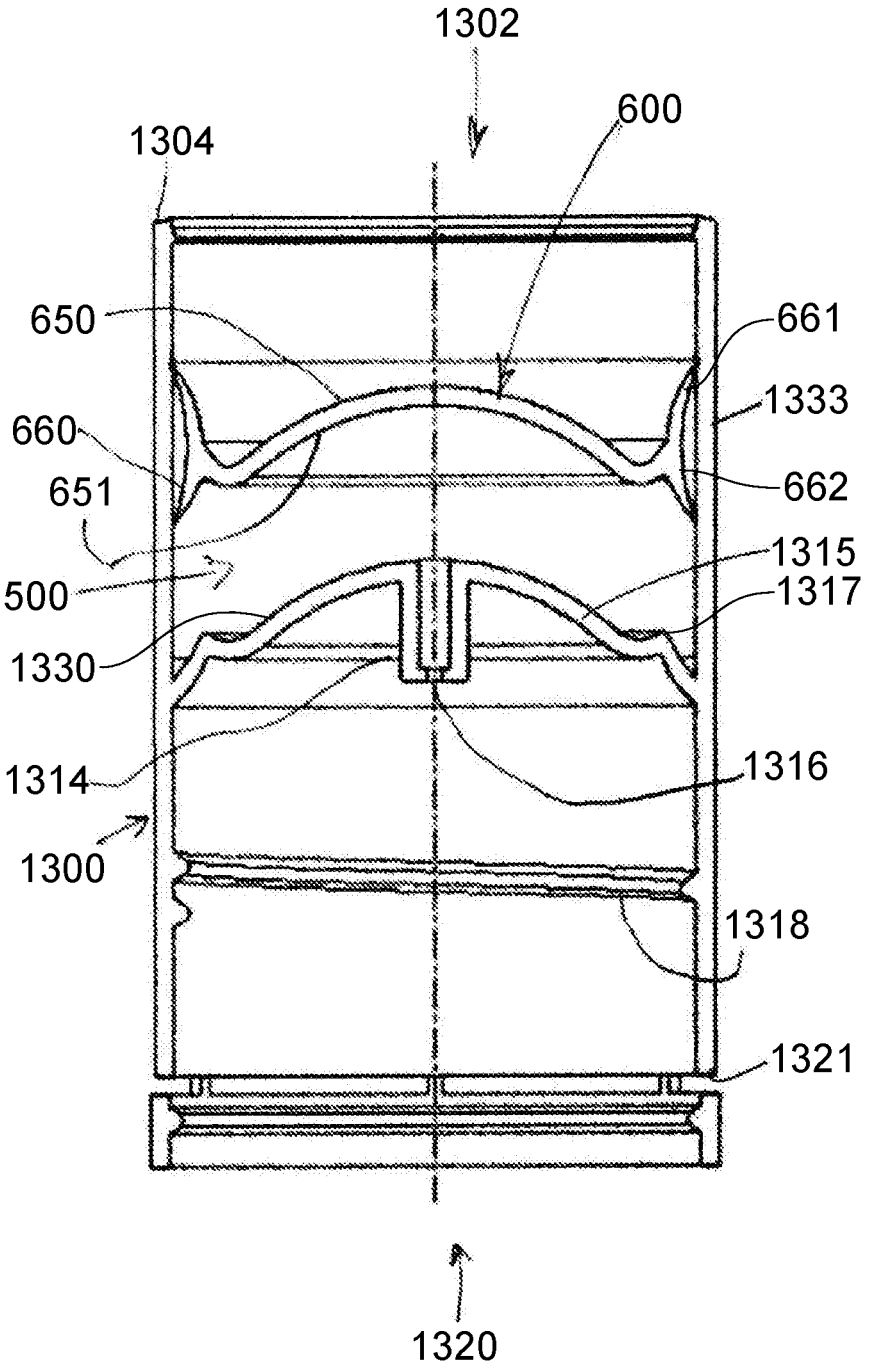
FIG. 13 shows the cross section of the liquid container wherein the piston is located where the reservoir is at half volume.
Figure 14:
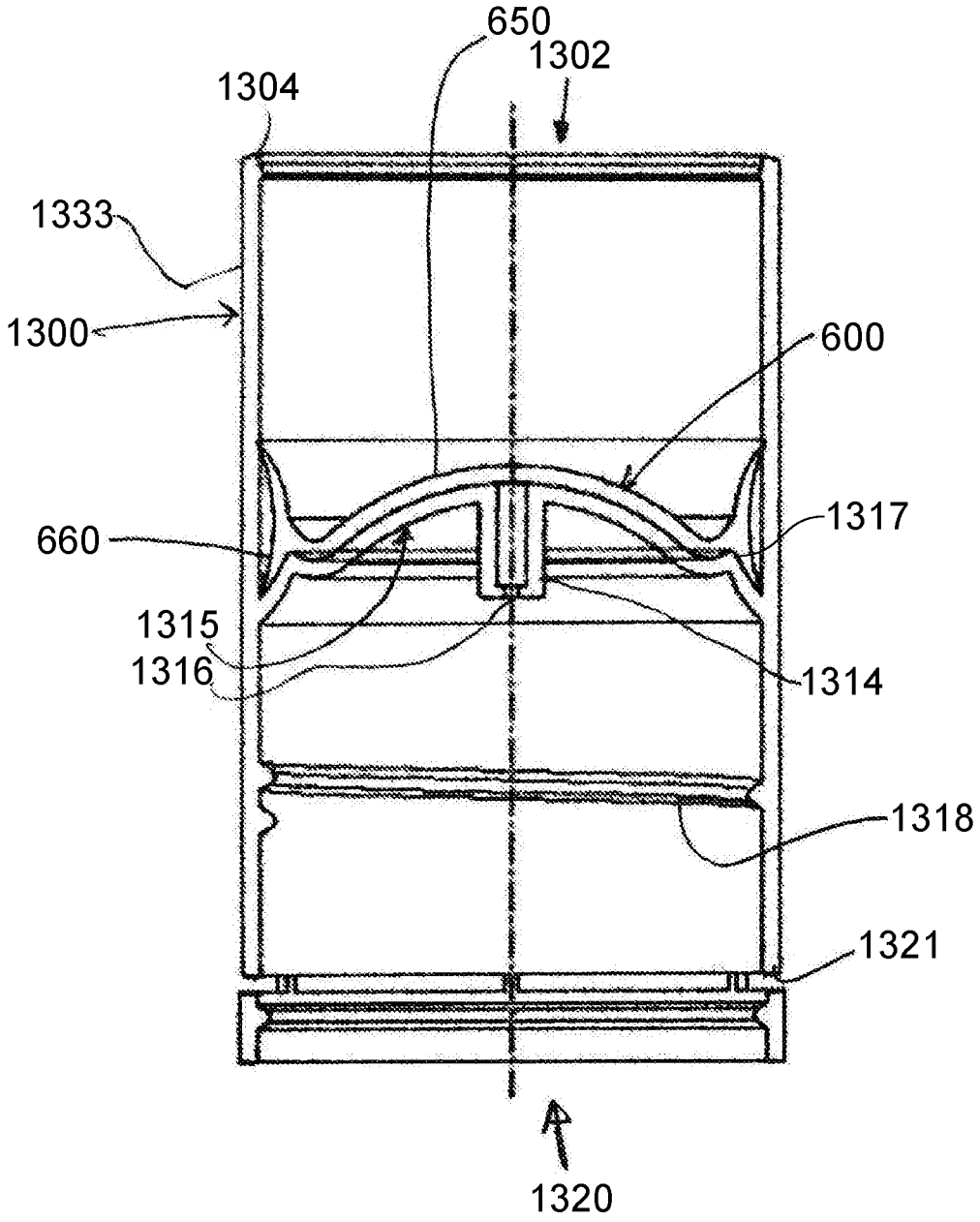
FIG. 14 shows the cross section of the liquid container wherein the piston is located where the reservoir is at nil volume.

From FIGS. 12 to 14 it can be seen how the dispensing portion comprises a piston 600 displaceable in the reservoir. The reservoir 500 is bounded by the piston 600 and a cylinder 333 formed in the liquid container. In FIG. 12 a cross section of the liquid container 11000 is shown except for the over-cap. The outer casing 1333 is tubular and has two opposite open ends 302, 320 separated by a partition 315.

The outer casing 1300 comprises a section 1330 partially enclosing the reservoir 1500. The section 1330 is intermediate the partition 1315 and the piston 600.

The outer casing 1300 also comprises a second section 1310 which receives the over-cap 120 through rim 1321 of the distal open end 1320. The second section is intermediate the partition 1315 and the rim 1321.

There is an internal screw thread 1318 on the second section for the outer casing 1300 to screw on to the over-cap.

The reservoir enclosure 1330 is formed by the partition 1315 and the tubular casing 1333 of the article.

The piston 600 slides in the reservoir enclosure 1330 and is sealed to the tubular casing of the article, which in FIG. 11 is shown to be cylindrical.

The piston is shown in the article 1300 which is a single unit, although it is not essential for the article to be a single unit. The article 1300 may comprise a separate reservoir enclosure 330 and socket 310 connected a joint proximate the partition 315, 1315 as shown in FIGS. 1, 8A to 8F, and 9A to 9F as described above.

In FIG. 11, the exterior surface of the piston head 650 is visible through the open end 1302 of the reservoir 1500 closed off by the piston 600. A portion of the cylinder tubular casing 1333 of the reservoir enclosure 1330 is visible intermediate the piston 600 and the rim 1304 of the open end.

The piston 600 is displaceable by pressing on the piston head 650. The piston head 650 is access-able by a user's fingers through the opening 1302 in the reservoir enclosure sealed off by the piston 600.

The article 1300 comprises the tubular casing 1333 around the reservoir enclosure 1330. There is a rim 1304 on the open end 1302 of the tubular casing which defines the open end 1302 of the reservoir enclosure 1330.

The piston 600 slides along the tubular wall or cylinder wall of the tubular casing 1333 from the partition 1315 to the rim 1304 of the open end 1302 which is closed off by the piston.

As shown in FIG. 12, where the piston 600 is proximate the rim 304 the reservoir 500 has maximum volume. When the piston is at this position the reservoir holds the maximum amount of the first beverage.

Proximate the rim 1304 the tubular casing 1333 comprises a bumper which protrudes into the interior of the reservoir enclosure 1330.

When the piston 600 is against the bumper 304, 1304, the volume of the reservoir is the maximum as shown in FIG. 12. The bumper prevents the piston 600 from exiting the reservoir enclosure 330, 1330.

The reservoir 1500 is enclosed by the tubular casing 1333 and the interior surface of the piston head 651, and the partition 315 that separates the reservoir 500 from the opening 320 in the container 300 for receiving the over-cap 120. Thus, the reservoir enclosed by the reservoir enclosure 1330 and the piston 650.

In FIG. 13, the piston 600 is shown midway intermediate the rim 304 and the partition 315 and the reservoir has half of the maximum volume. Half of the liquid which was in the reservoir when the reservoir was at maximum volume has been forced out through there aperture 1316 in the nozzle 1315 in partition 1315.

In FIG. 14 interior surface 651 of the piston 600 is shown abutted against the partition 1315. Displacing the piston 600 to this position forces the remaining liquid out of the reservoir 500. There is no first beverage left in reservoir 1500 because the reservoir has no volume. The piston 600 interior surface 651 and partition 1315 have matching contours which when brought into contact by displacement of the piston deprive the reservoir of volume.

Around the perimeter of the piston head is a sliding seal 660 comprising a resilient lip which slides along the cylinder wall 1333. The piston head is rigid to keep the resilient sliding seal pressed against the cylinder wall even when force is applied by a user to the exterior surface 650 of the piston head to squeeze liquid out of the reservoir. The user inserts their fingers through the open end 302 of the reservoir to push the piston 600.

The piston head has a concave curvature. The piston head bulges outward away from the reservoir. The partition 315, 1315 has a concave curvature that to match the piston head. The partition bulges into the reservoir 500, 1500.

The sliding seal is a friction coupling to the cylinder wall which holds the piston in place unless the piston is pushed. The sliding seal 660 comprises a flexible seal ring which is circumferential and makes circumferential contact with the inner wall of the outer casing 1330.

The seal ring comprises first membrane 661 which extends axially from the circumferential edge of the piston head toward the reservoir opening 1302 and a second membrane 662 which extends axially from the circumferential edge towards the partition 1315.

The seal ring prevents air and liquid from by-passing the nozzle while also providing sufficient friction to hold the piston in place unless it is intentionally pushed. The seal ring is not an essential element for a sealing the piston head because other seals such as an O-ring type seal is also effective.

There is a sharp reversal of curvature in the piston at the circumferential junction of the rigid piston head and the flexible seal ring.

The partition 1315 has a matching circumferential sharp reversal of curvature 1317 so that when the piston is pressed against the partition there is no air gaps. The sharp reversal of curvature 1317 provides a nook where the partition circumferential edge joins the outer casing. The second membrane is squeezed in the nook to improve the ejection of all the liquid from the reservoir.

The friction coupling provides at least enough friction force to hold the piston in place against the weight of the piston itself. The liquid in the reservoir is thereby held inside the reservoir and does not drip through the nozzle unintentionally. Air is never drawn into the reservoir. Since the liquid is incompressible, it never dribbles out of the nozzle. Thus, the piston may be partially depressed to eject a fraction of the liquid in the reservoir out of the nozzle. The remaining liquid in the reservoir is trapped and by its own surface tension and incompressibility and cannot dribble out. The remaining liquid be stored in the reservoir for later use.

The friction coupling may also be arranged to hold an additional weight of the first beverage occupying the full volume of the reservoir when the piston 600 is against the bumper 304, 1304 on the tubular casing of the article which prevents the piston from exiting the reservoir enclosure 330, 1330 as shown in FIG. 12. This allows the beverage to be ejected into the socket to use the socket as a cup for the first beverage without the first beverage flowing back into the reservoir displacing the piston.

The beverage cannot be ejected while the over-cap 120 is in place inside the socket 310, 1310 because the nozzle is blocked.

The article 300, 1300 may be unscrewed from the over-cap and the screw-on cap will remain on the bottle.

In the example shown the reservoir cylinder is a circular cylinder. Other perimeters for the piston such as oval, rectangular, square, and polygonal are possible. Circular and oval perimeters make the most inexpensive leak proof sliding seal to prevent liquid in the reservoir leaking past the seal.

Figure 15:
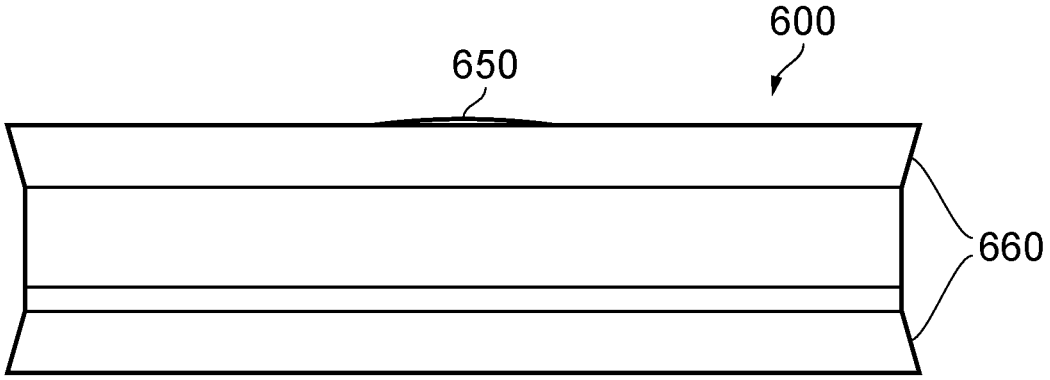
FIG. 15 shows an edge view of the piston.
Figure 16:
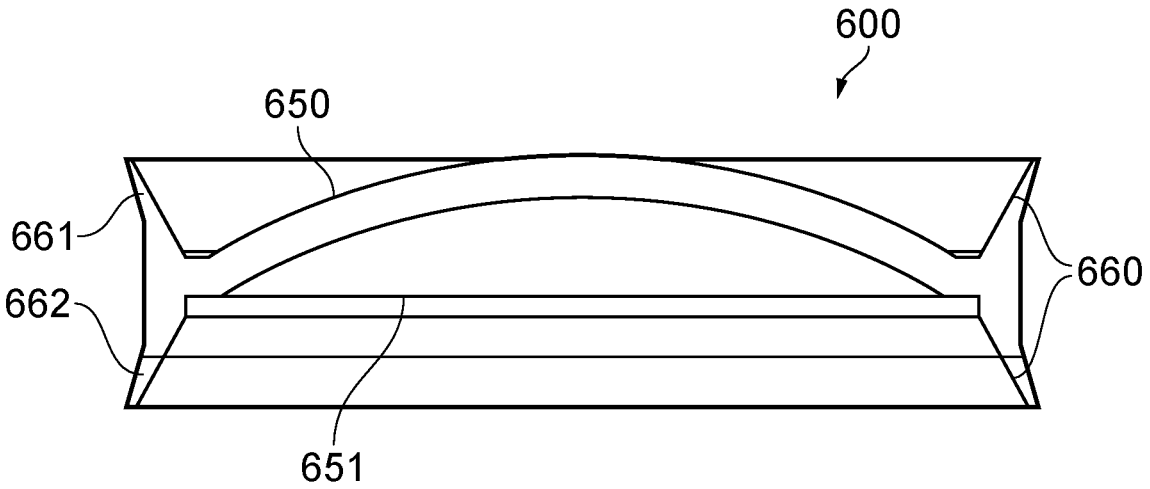
FIG. 16 shows a cross section of the piston.
Figure 17:
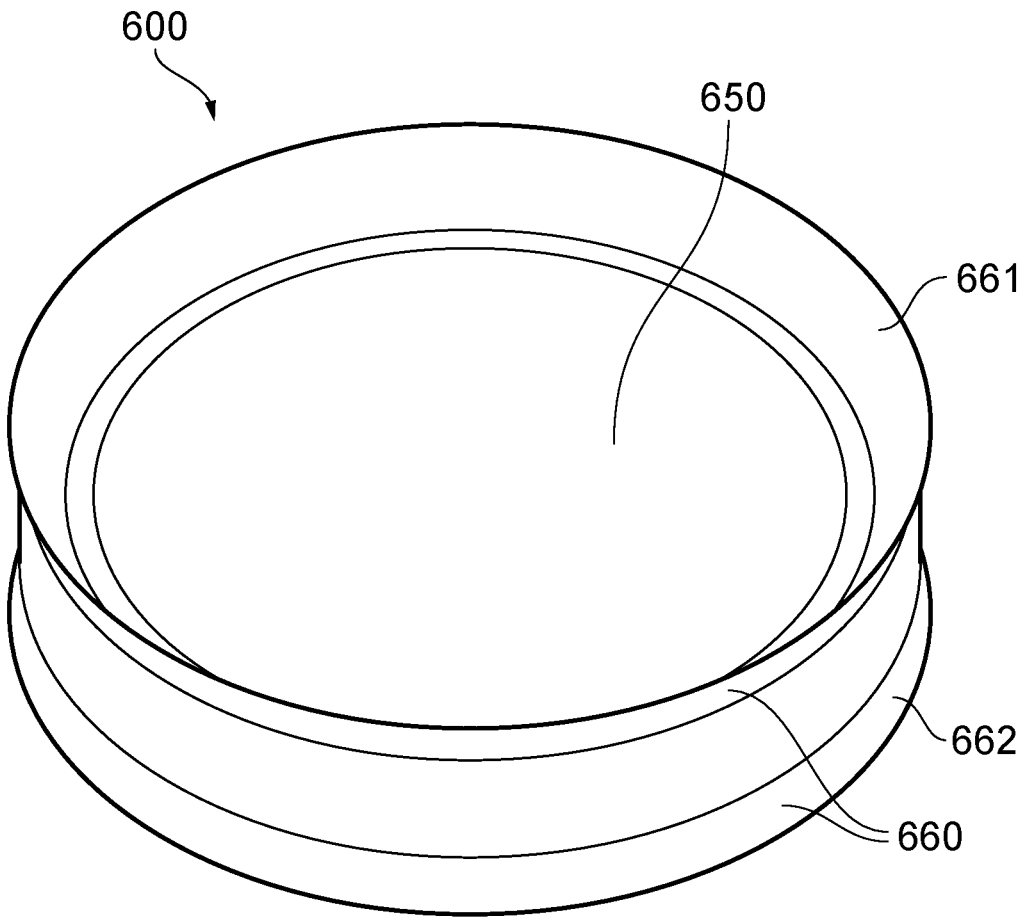
FIG. 17 shows an isometric view of the piston.

FIGS. 15, 16, and 17 show the piston 600 in detail in an edge view, cross section through the edge, and isometric view. As shown the piston 600 comprises a piston head having an exterior surface 650 and interior surface 651. The interior surface is a bounding surface of the reservoir 500.

The piston is mouldable as single unit with a thicker head portion and a thinner more sliding seal.

Index of Integers Shown in the Figures

| | |
|---|---|
| vessel cap, screw-on cap | 110 |
| screw-on cap screw thread | 112 |
| top of screw-on cap | 114 |
| over-cap | 120 |
| over-cap open end first rim | 123 |
| top of over-cap | 124 |
| skirt of over-cap | 125 |
| top of over-cap central depression | 126 |
| over-cap separate ring | 128 |
| over-cap fingers | 129 |
| over-cap circumferential gap | 130 |
| over-cap separate ring second circumferential rim | 131 |
| over-cap external screw thread | 133 |
| over-cap axially aligned ribs | 134 |
| over-cap external knurl on skirt | 135 |
| over-cap first lock device, protrusions. lugs | 137 |
| collapsible portion comprising button | 160 |
| collapsible portion circumferential sealing surface | 162 |
| collapsible portion interior surface | 164 |
| collapsible portion flexible button | 165 |
| vessel, bottle | 200 |
| neck of bottle screw-on thread | 210 |
| neck of bottle circumferential ridge | 220 |
| neck of bottle second lock device, stops, lugs | 222 |
| neck of bottle second lock device diametrically opposite lugs | 223 |
| article | 300 |
| reservoir opening in article closed off by flexible button | 302 |
| rim of reservoir opening | 304 |
| socket, connecting part to the over-cap | 310 |
| break-away ring | 311 |
| circumferential slot in outer casing of socket, connecting part | 312 |
| tubular casing of connecting part to over-cap | 313 |
| nozzle | 314 |
| partition, base of connecting part to over-cap | 315 |
| nozzle aperture | 316 |
| fragile stringers | 317 |

-continued

| | |
|---|---|
| internal screw thread on connecting part to over-cap | 318 |
| dimple or circumferential ridge on break-away ring | 319 |
| opening in socket to receive over-cap | 320 |
| rim of open end of socket, connecting part distal to base | 321 |
| reservoir enclosure, reservoir part | 330 |
| reservoir part circumferential ridge | 332 |
| outer casing of reservoir enclosure, reservoir part | 333 |
| flexible resilient flaps at end of reservoir part | 335 |
| seat on inner surface of cylinder wall | 337 |
| reservoir | 500 |
| piston | 600 |
| piston head exterior surface | 650 |
| piston head interior surface | 651 |
| piston seal lip | 660 |
| seal ring first membrane | 661 |
| seal ring second membrane | 662 |
| beverage container first embodiment | 1000 |
| article | 1300 |
| opening in reservoir enclosure sealed, closed off, by piston | 1302 |
| rim of reservoir opening closed off by piston | 1304 |
| socket, section which receives the over-cap | 1310 |
| break-away ring | 1311 |
| nozzle | 1314 |
| partition intermediate reservoir and opening to receive over-cap | 1315 |
| nozzle aperture | 1316 |
| sharp circumferential reversal of curvature | 1317 |
| internal screw thread on outer casing of socket | 1318 |
| open end of socket | 1320 |
| rim of open end of socket | 1321 |
| reservoir enclosure, section intermediate partition and piston | 1330 |
| outer casing of reservoir enclosure, reservoir part | 1333 |
| reservoir | 1500 |
| beverage container second embodiment | 11000 |

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

The invention claimed is:

1. A liquid container comprises:

an over-cap detachable from a body, the over-cap detachably connects the body to a vessel and covers an entrance to the vessel to close the entrance;

a portion of the body is adapted to be squeezed or displaced to dispense a liquid from a reservoir in the body through a passage through the body;

wherein a portion of the over-cap for covering the entrance comprises a shutter for unshutting and re-shutting the passage, the over-cap and a portion of the body which receives and attaches to the over-cap cooperate to hold the over-cap on the vessel to close the entrance so that the shutter unshuts the passage as the body is detached from the vessel.

2. The liquid container according to claim 1 wherein the portion of the body that is adapted to be squeezed or displaced to dispense the liquid from the reservoir is a piston that is slide-able in the reservoir.

3. The liquid container according to claim 2 wherein the body comprises an assembly of the portion adapted to be squeezed or displaced, and an article which partially encloses the reservoir, wherein the reservoir is enclosed by the piston when assembled with the article.

4. The liquid container according to claim 3 wherein the article includes an opening to receive the piston for assembly and to provide finger access to a head of the piston to operate the piston.

5. The liquid container according to claim 1 wherein the over-cap connects to a vessel cap comprising pasteurizable material and connects to the vessel.

6. The liquid container according to claim 1 wherein the body comprises an assembly of the portion adapted to be squeezed or displaced, and an article which partially encloses the reservoir.

7. The liquid container according to claim 6, wherein the over-cap is detachable from the article.

8. The liquid container according to claim 6 wherein the portion of the body which receives and attaches to the over-cap is a socket, and the socket is formed in the article.

9. The liquid container according to claim 1 wherein the over-cap comprises a first lock to form an interlock with a second lock on the vessel to hold the over-cap on the vessel.

10. The liquid container according to claim 9 wherein the body comprises holding means to prevent the first lock from being freed of the interlock as the body is detached from the vessel.

11. The liquid container according to claim 1 wherein the portion of the body which receives and attaches to the over-cap is a socket.

12. The liquid container according to claim 11 wherein the body is mountable on the vessel over the entrance by the over-cap received in the socket.

13. The liquid container according to claim 11, wherein the passage is from the reservoir into the socket.

14. The liquid container according to claim 11, wherein the body is formed to have a hollow interior, the body comprising a partition dividing the hollow interior to form the socket and the reservoir.

15. The liquid container according to claim 14 wherein the passage is through the partition.

16. The liquid container according to claim 11 wherein the socket is the portion of the body which receives and attaches to the over-cap and cooperates with the over-cap to hold the over-cap on the vessel.

17. The liquid container according to claim 1 wherein the portion of the body that is adapted to be squeezed or displaced to dispense the liquid from the reservoir is a piston that is slide-able in the reservoir, the body is formed to have a hollow interior, the body comprising a partition dividing the hollow interior to form the socket and the reservoir, and the partition and piston have mating surfaces with matching contours for ejecting substantially all the liquid from the reservoir.

18. The liquid container according to claim 1 wherein the passage is a nozzle.

19. A storage and dispensing system comprising the liquid container according to claim 1 and the vessel.

* * * * *